United States Patent [19]

Budelman et al.

[11] 4,215,619

[45] Aug. 5, 1980

[54] SYSTEM FOR RECORDING AND AUTOMATIC PLAYBACK OF A MUSICAL PERFORMANCE

[75] Inventors: Gerald A. Budelman, Aloha, Oreg.; James A. Turner, Stamford, Conn.

[73] Assignee: CBS Inc., New York, N.Y.

[21] Appl. No.: 972,625

[22] Filed: Dec. 22, 1978

[51] Int. Cl.[2] ..... G10H 1/02; G10H 5/00

[52] U.S. Cl. ..... 84/1.28; 84/1.24; 84/115; 84/462; 84/DIG. 30

[58] Field of Search ..... 84/1.01, 1.03, 1.24, 84/1.28, 115, 462, DIG. 30

[56] References Cited

U.S. PATENT DOCUMENTS

| | | | |
|---|---|---|---|
| 3,604,299 | 9/1971 | Englund | 84/1.03 |
| 3,610,799 | 10/1971 | Watson | 84/1.01 |
| 3,683,096 | 8/1972 | Peterson et al. | 84/115 |
| 3,829,597 | 8/1974 | Peterson et al. | 84/1.03 |
| 3,905,267 | 9/1975 | Vincent | 84/115 |
| 4,104,950 | 8/1978 | Finley | 84/462 |
| 4,132,141 | 1/1979 | Campbell et al. | 84/115 |
| 4,132,142 | 1/1979 | Campbell | 84/115 |

*Primary Examiner*—S. J. Witkowski

*Attorney, Agent, or Firm*—Martin M. Novack; Spencer E. Olson

[57] ABSTRACT

A musical keyboard instrument is disclosed for recording and storing a musical performance and then automatically playing back the performance. As is conventional, a keyboard having a plurality of keys is provided, along with musical tone generators that are associated with the keys. In accordance with the disclosed invention, means are provided for sensing, at a sensing time, those of the keys which are activated. A sequence of frames are generated, each frame including digital information representative of the keys that are activated at a given sensing time. The duration of each frame is a function of the relative locations of the keys activated at a given sensing time, and is therefore a duration which can vary from frame to frame. Each sensing time is determined by the previously completed frame, i.e., when a frame is complete, the statuses of the keys are again sensed so that the next frame can be generated. The sequences of frames are stored on magnetic tape. In a preferred form of the invention, the keys are divided into groups or "ports", and the digital information for each frame includes identification of the ports that have one or more activated keys and identification of the individual keys that are activated within that port. The rationale of this coding scheme is particularly compatible with the physical characteristics and manual dexterity of a human playing a keyboard instrument. The digital information of each frame is encoded in frequency shift keyed form and frequency shift keyed signals are recorded by generating digitally synthesized sinusoidal signals for application to magnetic tape.

68 Claims, 20 Drawing Figures

SYSTEM FOR RECORDING AND AUTOMATIC PLAYBACK OF A MUSICAL PERFORMANCE

BACKGROUND OF THE INVENTION

This invention relates to musical instruments and, more particularly, to a musical keyboard instrument having an automatic playing capability.

For many years the player piano has been a well known musical instrument having an automatic playing capability. Player pianos traditionally utilize paper rolls having punched hole information therein, the punched hole information being read by a device in the player piano which, in turn, activates appropriate keys thereof. Typically, the positions of each row of holes in the paper correspond to keys to be activated at a given instant. In most respects, the paper roll technique has become obsolete, the paper rolls being cumbersome and fragile, and generally not having the information carrying capability to effect quality reproductions of a sophisticated musical performance. Also, it has not been possible for the user of the player piano (or other keyboard instrument) to record his or her own musical performance for later playback.

There have recently been developed a number of systems which are capable of recording, typically on magnetic tape, and key actuations of a musical performance on a keyboard instrument, generally an electronic musical instrument such as an electronic organ. With these systems it is possible for the user to record his or her musical performance on magnetic tape for subsequent playback. Playbacks is in the manner of a player piano and allows musical reproduction by the instrument which is of much greater quality than if the audio had itself been recorded on magnetic tape in conventional analog fashion. In addition to entertainment advantages, these systems are useful as teaching aids or selling tools, and conventional audio can be provided, for various purposes, on a separate track of the magnetic tape. Systems of the described type are disclosed, for example, in U.S. Pat. Nos. 3,604,299, 3,610,799, 3,683,096, 3,829,597, and 3,905,267.

The most prevalent scheme used for recording the instrument key actuations is to provide a basic "cycle" or "frame" rate of, say, 100 cycles per second. During each cycle, each key of the keyboard (as well as other information such as the positions of "stops" and the instrument loudness or "expression") is interrogated, and a special signal is generated for each key that is determined to be active during the cycle. For example, in a "time division multiplexing" scheme disclosed in some of the above-referenced patents, the keys are sampled in a specified sequence with each key having its own "time slot" during the cycle. Thus, for example, if there are 100 keys (including the keys themselves plus stop, switches, etc.), there would be 100 time slots, with a relative position of each time slot in the sequence uniquely representing the activation (or non-activation) of a key. Using this example, if there are 100 cycles (or frames) per second, and 100 time slots per cycle, then a bit frequency of 10 KHz would be necessary to represent and record, in digital form a musical performance. Actually, a somewhat higher bit frequency would be necessary since a portion of the frame may be needed for recording synchronizing information (e.g., to separate cycles or frames from one another).

The described systems, and other prior art techniques, are believed to provide less than optimum performance for various reasons. First, for the number of keys being encoded, the basic frequency requirements are believed to be unnecessarily high. Since the signal is typically to be recorded on limited quality magnetic tape equipment (e.g., a standard tape cassette system), it is desirable to keep the bit frequency requirements as low as possible so as to minimize the problems associated with storing digital information on tape and faithfully recovering the information. The basic frequency of operation could, of course, be lowered by lowering the cycle (or frame) rate; i.e., the rate at which the keys are interrogated. However, it must be insured that this does not result in the user being able to "outplay" (i.e., play faster than) the equipment, a factor which depends upon the playing efficiency of the user. Summarizing considerations of bit frequency: for a given number of keys and a given level of user proficiency, it is desirable to employ a coding rationale which utilizes a bit frequency that is as low as possible.

Once an encoding rationale has been devised, it is necessary to put the information in a form that is suitable for recording on the recording medium, typically magnetic tape. The information should be recordable and recoverable in a manner which is efficient and also not susceptible to errors caused by the recording or recovery processes. Also, in the event an error occurs, it is desirable that the system handle errors in a way which is least disturbing during playback.

It is among the objects of the present invention to provide solution to the types of problems set forth and to generally provide an improved musical keyboard instrument having an automatic playing capability.

SUMMARY OF THE INVENTION

The present invention is directed to a musical keyboard instrument for recording and storing a musical performance, and also to a musical keyboard instrument having an automatic playing capability. As is conventional, a keyboard having a plurality of keys is provided, along with musical tone generators that are associated with the keys. In accordance with the invention, means are provided for sensing, at a sensing time, those of the keys which are activated. Further means are provided for generating a sequence of frames, each frame including digital information representative of the keys which are activated at a given sensing time. The duration of each frame is a function of the relative locations of the keys activated at a given sensing time, and is therefore a duration which can vary from frame to frame. Each sensing time is determined by the previously completed frame. In the embodiment hereof, this means that when a frame is complete the statuses of the keys are again sensed so that the next frame can be generated. Means are provided for storing sequences of the frames, preferably on magnetic tape.

With regard to the automatic playing capability of the invention, means are provided for reading out stored sequences of frames and for decoding the information in the read out frames. Means are then provided for activating the instrument tone generators in accordance with the decoded information.

In a preferred embodiment of the invention, the keys are divided into groups or "ports", and the digital information for each frame includes identification of the ports that have one or more activated keys and identification of the individual keys that are activated within that port. In particular, each frame will have N units of port/keys bits, where N is the number of ports that has one or more active keys. In the illustrated embodiment, each unit of port/keys bits has fifteen bits of information; i.e., five bits which represent (in binary form) the reference number of the port having active keys, eight bits which represent (on a one bit per key basis) the active/inactive status of each individual key of the port, and two bits which are the parity bits for the port identification and the keys identification, respectively. Accordingly, it will be understood that if, at a particular sensing time, there are active keys in no ports, there will be no port/keys bits, if there are active keys in one port, there will be fifteen port/keys bits, if there are active keys in two ports, there will be thirty port/keys bits, and so on. In addition to the port/keys bits, each frame also includes a "frame marker" which identifies it as a new frame, and each frame also includes groups of bits which represent the expression and represent the status of control switches or stops at the particular sensing time at which the frame was formulated. However, it is seen that the frame duration is considerably variable, depending upon the number of ports which include active keys at the particular sensing time. Due to practical playing constraints on a keyboard instrument, which relate to human physical characteristics and manual dexterity, the stated encoding rationale has substantial advantage, as will become clear.

To better understand the consequences of other encoding rationales and the advantages of the present invention, it is helpful to consider examples of what one could expect using existing or alternative approaches. First, consider an encoding rationale of the type described in the background portion hereof. For a system having 192 keys (as will be used in an illustrative embodiment hereof), and for a frame rate of 30 per second, one can readily calculate that this situation would require a bit frequency of 5.76 Kilobits (equals $192\times30$) per second. If one were to instead encode by storing the address of every activated key, an 8 bit address would be required for 192 keys. Assuming that about 10 notes can be played at once (including hands and feet on the organ), a frame rate of 30 frames per second would yield a required bit frequency of 2.4 Kilobits (equals $8\times10\times30$) per second. With the technique of the preferred embodiment of the present invention, the 192 keys are represented by 24 ports with 8 keys in each port. As noted above, a 5 bit port address is used, and 8 bits represent the individual key statuses. Assuming that 5 ports are active at once, a 30 frame per second frame rate would yield a bit frequency of 1.95 Kilobits per second. In addition to this apparent advantage in bit frequency, it will be understood that during much of the playing time less than 5 ports will be active. In the present invention the frame rate will automatically adjust to a much shorter duration (higher information rate) when less ports have active keys.

It will become understood that an advantage of the present invention flows from the fact that, as a practical matter, the type of keyboard playing which results in relatively long frames (i.e., frames wherein keys from a number of different ports are active at the same time) will generally not require the fastest frame rate. For example, when extensive chords are being played with both hands, the speed at which the player progresses to new keys will typically not be as fast as, say, where at least one hand is playing a fast series of keys. In the latter instance, it may be desirable to operate at the highest (shortest duration) frame rate so that the recorded information will assuredly "keep up" with the player. In the present invention, this result will be forthcoming since this latter type of playing results in less ports with active keys and, consequently, less ports/keys units in a frame, ergo shorter frames. Accordingly, the rationale of the present coding scheme is seen to be particularly compatible with the physical characteristics and manual dexterity of the player of a keyboard instrument.

In the preferred embodiment of the invention, the digital information of each frame is encoded in frequency shift keyed form. Preferably, the code of the frequency shift keying is formulated with a first frequency representative of the frame marker, a second higher frequency representative of one binary state, and a third even higher frequency representative of another binary state. The frequency shift keyed code is self-clocking, has no DC component, and is relatively easy to decode. Also, by using the highest frequency for the most prevalent bit (such as a logical "0"), the duration of the average frame is minimized. In accordance with a further feature of the invention, frequency shift keyed signals are recorded by generating digitally synthesized sinusoidal signals for application to magnetic tape. In this embodiment, the sinusoidal signals are applied to the magnetic tape with the frequency shifts at the sinusoidal peaks. In this manner, the ninety degree phase shift inherent in the recording process results in the keyed phase shifts occurring at the zero-crossing points, as is desirable for decoding.

Further features and advantages of the invention will become more readily apparent from the following detailed description when taken in conjunction with the accompanying drawings.

DESCRIPTION OF THE PREFERRED EMBODIMENT

Figure 1:
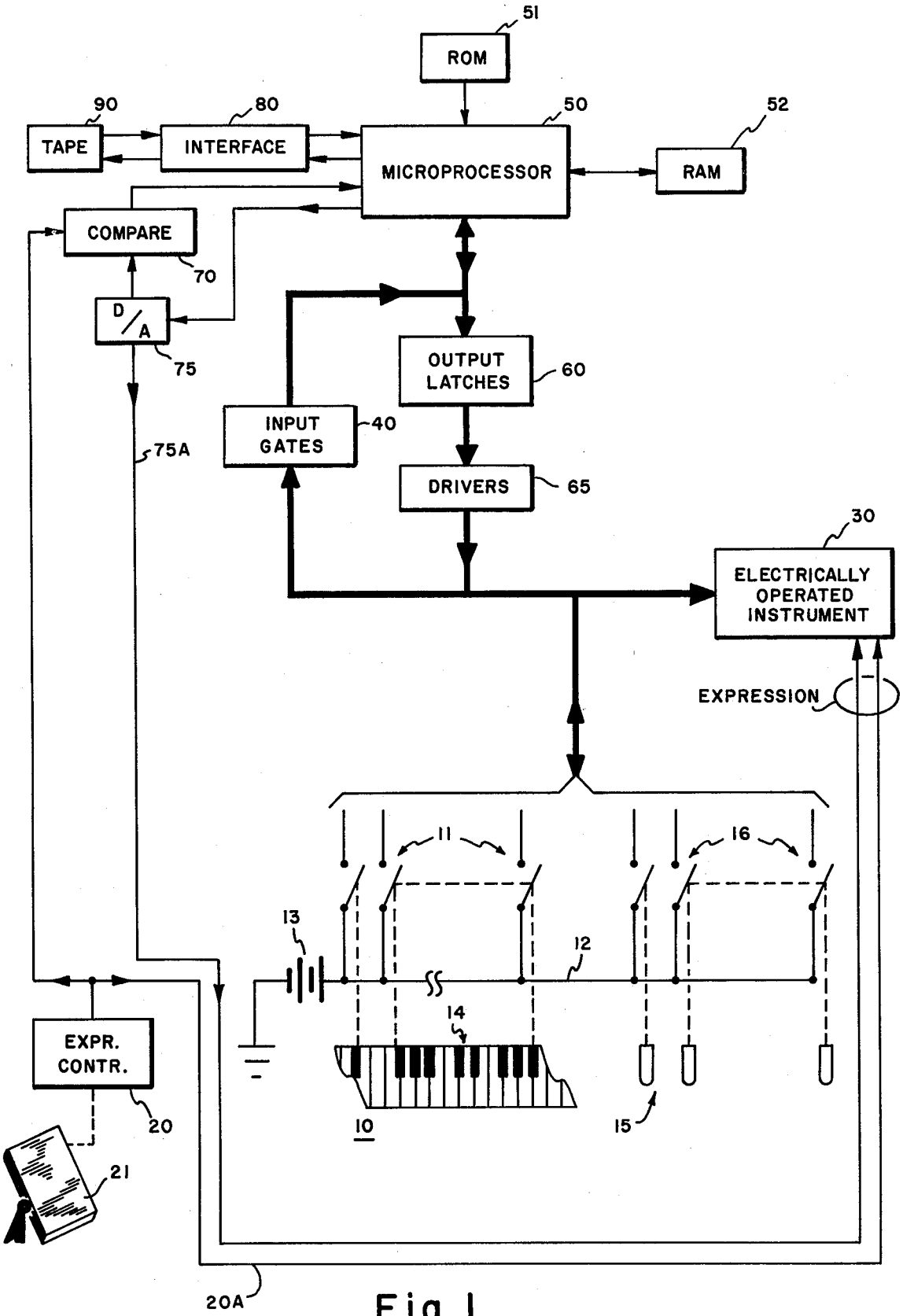
FIG. 1 is a block diagram of a musical keyboard instrument having an automatic recording and playing capability in accordance with an embodiment of the invention.

Referring to FIG. 1, there is shown a block diagram of a musical keyboard instrument having an automatic recording and playing capability in accordance with an embodiment of the invention. A keyboard (or multiple keyboards) 10 has keys, for example, 192 keys 14, each of which operates a keyswitch 11. One terminal of each keyswitch 11 is connected to a bus 12, which is connected to a power supply 13. Seven stop tablets 15 couple to stop switches 16 which determine stop functions or any other desired status or control functions, as will be described below. One terminal of each of switches 16 is connected to bus 12. The other terminal of switches 11 and 16 are coupled to the electronically operated musical instrument 30, for example, the tone generators of an electronic organ. A volume or expression control 20 is operated by an expression level selector 21, the expression level also being coupled to the electronically operated musical instrument 30. For conventional playing of the instrument, the keys 14, stop tablets 15 and/or expression control 20 are operated and the voltage of power supply 13 and the expression-representative voltage are thereby applied to the appropriate terminals of the electroncially operated musical instrument 30.

The positions of switches 11 and 16 are sensed via input gates 40 that are, in turn, coupled to a processing module 50 which may be, for example, a Model Z80-CPU microprocessor manufactured by Zilog Corp. of Cupertino, Calif. The microprocessor 50 may have any suitable auxiliary memories and, in the present embodiment, a 1K×8 ROM 51 is utilized for storing the program, and a 128×8 RAM scratch pad memory 52 is also provided. Addressing and data lines coupling the microprocessor 50 to the input gates 40 during playing of the instrument are also coupled to output latches 60 for use during automatic playback. The output latches 60 are coupled to drivers 65 that are operative to effectively activate the switches 11 and 16. In the present embodiment the illustrated keys and switches use 199 input gates (reference numeral 40) and 199 output latches (reference numeral 60) which control 199 drivers (reference numeral 65). It will be understood that these are representative numbers for a musical instrument having a relatively large keyboard (typically multiple keyboards), but suitable scaling down (or up, if necessary) can readily be implemented for smaller (or larger) keyboard instruments.

The signal representative of the expression level is coupled, in analog form, from expression control 20 to a comparator 70 which receives as its other input, via D/A converter 75, a signal from the microprocessor 50. The output of comparator 70 is coupled to microprocessor 50. As will become clear, this loop is used to sense the expression level during playing. A further output line 75A from D/A converter 75 is used during automatic playback when expression-representative digital signals from microprocessor 50 control the expression of the musical instrument.

The microprocessor 50 is also coupled to an interface 80 which is, in turn, coupled to a memory that is typically a magnetic tape storage device, such as a magnetic tape cassette machine 90. Information may be either serially applied from the microprocessor 50, via interface 80, to the tape machine; or information read from the tape machine, via interface 80 into the microprocessor 50. In addition to a track on the tape for storing digital-representative signals in accordance with principles of the invention, it will be understood that the tape may have multiple additional tracks for storage of other information, for example, conventional audio information.

General operation of the system of FIG. 1 is in three basic modes, two of which are of particular interest herein. In a first or conventional mode of operation, the musical instrument is utilized in ordinary fashion, and the input gates 40, the output latches 60, and the expression-related units 70 and 75 are all inoperative. This mode is of no particular interest herein. In an "encoding" (or "record") mode of operation, as the instrument is played, the statuses of switches 11 and 16 are interrogated (or "sensed") by the microprocessor 50 via the input gates 40. The expression is also sensed via comparator 70. Using the information it receives in the encoding mode, the microprocessor 50 generates frames of digital data which are sequentially applied to magnetic tape via interface 80. In this manner, the musical performance which is being played on the musical instrument is simultaneously recorded on the tape in terms of the key and expression statuses at given sensing times. In the third mode of operation, known as "decode" or "automatic playback", the frames of data are read from the tape into microprocessor 50 via interface 80. The frames are decoded and the output latches 60 are activated to drive the drivers 65 which, in turn, activate the switches 11 and 16 so that the electronically operated musical instrument 30 is automatically played. Signals from the microprocessor to the expression control 20, via digital-to-analog converter 75, control the expression of the instrument during this automatic playback mode of operation.

Figure 2:
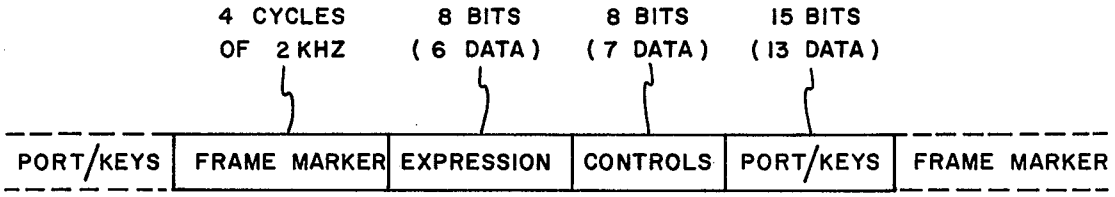
FIG. 2 illustrates the format of a frame of information that is ultimately recorded on magnetic tape in an embodiment of the invention.
Figure 4:
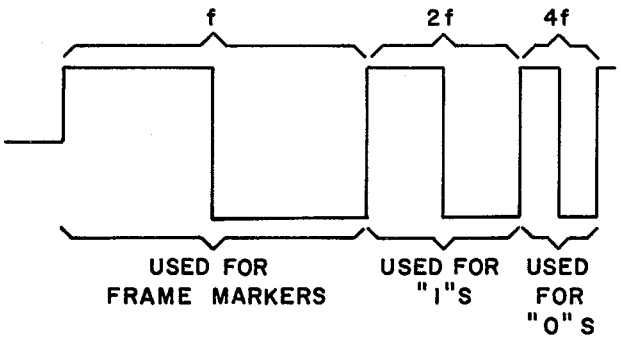
FIG. 4 illustrates the basic frequency relationship used in a frequency shift keying code in accordance with an embodiment of the invention.

Referring to FIG. 2, there is shown the format of a frame of information that is ultimately recorded on magnetic tape and represents the instantaneous status of all keys of the keyboard (as well as other information) at a given sensing instant. Sequences of frames are recorded on the magnetic tape, with the frame rate being fast enough to allow recording and subsequent reproduction of a performance on the instrument without noticeable loss of musical quality. The frame begins with a "frame marker" which is preferably a plurality of cycles of a signal at the lowest frequency to be recorded on the tape, four cycles of 2 KHz signals being used in this embodiment. Applicants employ a frequency shift keying code in the present invention, and set forth a scheme wherein frequencies of f, 2f, and 4f are used to respectively represent the frequency indicative of a frame marker, the frequency indicative of a binary "1", and the frequency indicative of a binary "0". The basic frequency relationships are illustrated in FIG. 4. Since binary "0's" are most prevalent in the coding scheme utilized, an economy of time and space on the tape is achieved. Also, as will become understood, the relatively lower frequency of the frame marker is particularly advantageous during encoding in that time is provided during the generation of the frame marker signal during which the state of the instrument keys, etc., can be interrogated and encoded.

Returning to the frame format of FIG. 2, the frame marker is followed by eight data bits (binary bits) that represent the instantaneous loudness or "expression" of the musical instrument. The first of the eight bits is a "transition" bit that is always a "1". Since a "1" is represented by the intermediate frequency (2f), 4 KHz in this case, the insertion of a "1" as the first expression bit insures that there is no transition from the lowest ("frame marker") frequency to the highest ("0") frequency. Another of the expression bits is a parity bit, so six of the expression bits are actual data bits which represent sixty-four possible levels of expression of the musical instrument.

Figure 3A:
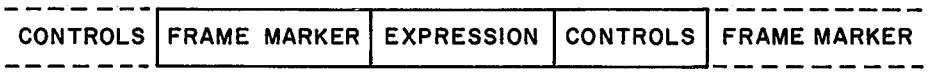
FIGS. 3A and 3B illustrate short and long frames in accordance with the invention.
Figure 3B:
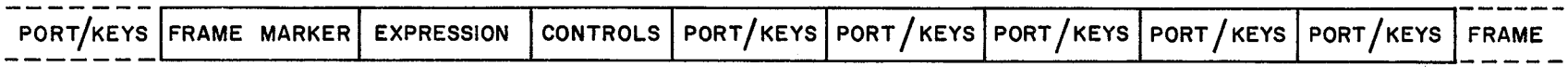

Following the expression bits come eight "controls" bits. One of these is a parity bit, and the other seven bits represent the states of switches or stops of the musical instrument. (stops 15 of FIG. 1). After the controls bits come either no units or one unit or more units of "port-/keys" bits representative of the active/inactive status of all keys on the keyboard of the musical instrument. In FIG. 2, the illustrated frame has one 15 bit unit of port-/keys bits, this being the type of frame that will be generated when only one port contains active keys. In FIG. 3A there is shown the shortest frame in this scheme; i.e., no port/keys bits, as will result when no keys of the keyboard are active. In contrast, FIG. 3B illustrates a relatively long frame wherein five units of port/keys bits are included in the frame, as would result when five different ports each contain active keys. In the present embodiment the shortest frame has a duration of about 3 milliseconds, and each port/keys unit adds about 3 milliseconds to frame duration (bearing in mind that these are averages and that the actual durations will vary somewhat since a "1" takes $\frac{1}{4}$ millisecond and a "0" takes $\frac{1}{8}$ millisecond). Accordingly, even if there were active keys in eight different ports, which is quite unlikely, the frame duration would still be less than about 30 milliseconds.

Each of the port/keys units includes 15 bits; i.e., 5 bits representative of the port reference or index number (which uniquely identifies the physical location of the port), 8 bits representative of the statuses of the keys within the particular port location, 1 parity bit for the port, and 1 parity bit for the keys. The 5 bits port index means that there are $2^5$ (i.e., 32) identifiable ports, and the 8 key bits identify the active/inactive status of each of the 8 keys of the particular port. Accordingly, 256 keys can be independently represented using this coding rationale. In the present embodiment, the musical instrument has 192 keys, so only 24 of the possible 32 port codes need be utilized ($24\times8=192$), but it will be understood that additional available ports could be used to expand the number of keys or to code other information such as the status of additional stops, etc. The keys of each port are, to the degree possible, adjacent groups of keys on the keyboard. Since the player of the instrument has only 2 hands and 2 feet, there is a practical limitation on the number of ports which can possibly contain active key data at a given instant. This is highly advantageous in limiting the size (and duration) of a given frame.

As previously stated, the number of port/keys units in a frame (and therefore the duration of the frame) will depend upon the location of the keyboard keys that are active at a given instant. If only a single key of the keyboard is being played (i.e., is "active"), the resultant frame will have just one unit of 15 port/keys bits (as in FIG. 2). For example, if the index number of the port is 12 (decimal) and the active key is the last (rightmost) one of its particular port (called key No. 8), then the unit of port/keys bits might be expressed as: "01100 00000001 01" where the first five bits represent the port index number in binary form, the next 8 bits represent the states of the individual keys within the port (only the last of these being active in this example), and the last 2 bits represent the parity bits for port bits and keys bits, respectively. If additional keys were active within the same port at the instant in question, it will be understood that this situation is still representable in the frame by a single unit of 15 port/keys bits. For example, if the first, fourth, sixth and eighth keys of the same port (port index No. 12) were active, then the appropriate unit of port/keys bits would be: "01100 10010101 00". In situations where the keys active at a given instant are located in more than one port, the resultant frame will have a plurality of units of port/keys bits. For example, assume that at a given instant key No. 7 is active in port No. 13, key Nos. 1 and 3 are active in port No. 14, and keys Nos. 4, 6 and 8 are active in port No. 20. The units of port-/keys bits would the be as follows:

(01101 00000010 11) (01110 10100000 10) (10100 00010101 01)

where the parentheses separate the three port/keys bits units of this frame for purposes of illustration, although in the present embodiment no separation between successive units of port/keys bits is utilized.

From the foregoing, it will be understood that an advantage of the present invention flows from the fact that, as a practical matter, the type of keyboard playing which results in relatively long frames (i.e., frames wherein keys from a number of different ports are active at the same time) will generally not require the fastest frame rate. For example, when extensive chords are being played with both hands, the speed at which the player progresses to new keys will typically not be as fast as, say, where at least one hand is playing a fast series of keys. In the latter instance, it may be desirable to operate at the highest (shortest duration) frame rate so that the recorded information will assuredly "keep up" with the player. In the present invention, this result will be forthcoming since this latter type of playing results in less ports with active keys and, consequently, less port/keys units in a frame, ergo shorter frames. Accordingly, the rationale of the present coding scheme is seen to be particularly compatible with the physical characteristics and manual dexterity of the player of a keyboard instrument.

Figure 5:
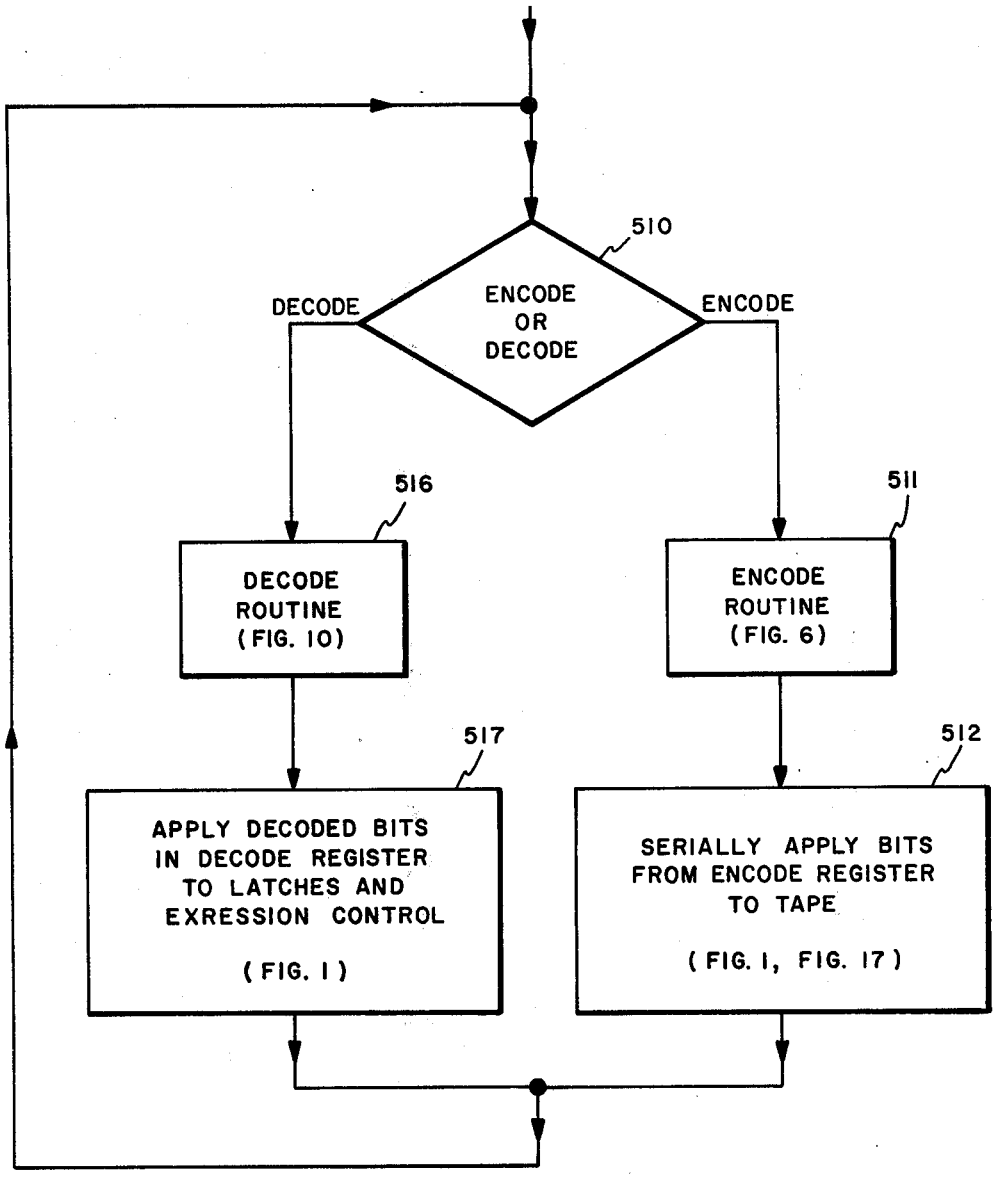
FIG. 5 is a simplified basic flow diagram for the functions performed by the circuitry of the FIG. 1 embodiment.

Referring to FIG. 5, there is shown a simplified basic flow diagram for the functions performed by the circuitry of FIG. 1. A determination is initially made (diamond 510) as to whether the instrument is in an encoding or a decoding mode of operation, encoding being used when musical information is to be recorded, and decoding being utilized when the tape is being played back and used to effect automatic playing of the musical instrument. Typically, the player or user of the musical instrument will select the mode via a switch. A third switch position can be used for unrecorded playing of the instrument. (Alternatively, playing in the encode mode, but without a tape, can be used for unrecorded playing.)

If the encode mode is active, the encode routine is entered, as represented by block 511. This routine is described below in conjunction with FIG. 6 and the FIGS. which depend therefrom. Briefly, the encoding involves sensing of the locations of the active keys, sensing of expression and of "controls" functions, and forming the frame of information to be applied the recording medium, which is magnetic tape in the present embodiment. The block 512 is then entered, this block representing the serial application of the frame (which is, after encoding, temporarily stored in an "encode register") to the magnetic tape. The subsystem for achieving this function is described below in conjunction with FIG. 17.

If the system is in the decoding mode of operation, the block 516 is entered, this block representing the decode routine of FIG. 10 which will also be described hereinbelow. Briefly, the decode routine is operative to decode the information read from the tape, frame by frame, to obtain the bit information contained in a frame. This information is stored in a "decode register." The block 517 is then entered and the decoded bits are applied to control the latches 60 (FIG. 1) and the expression control. The diamond 510 is then re-entered and the next frame is processed.

Figure 6:
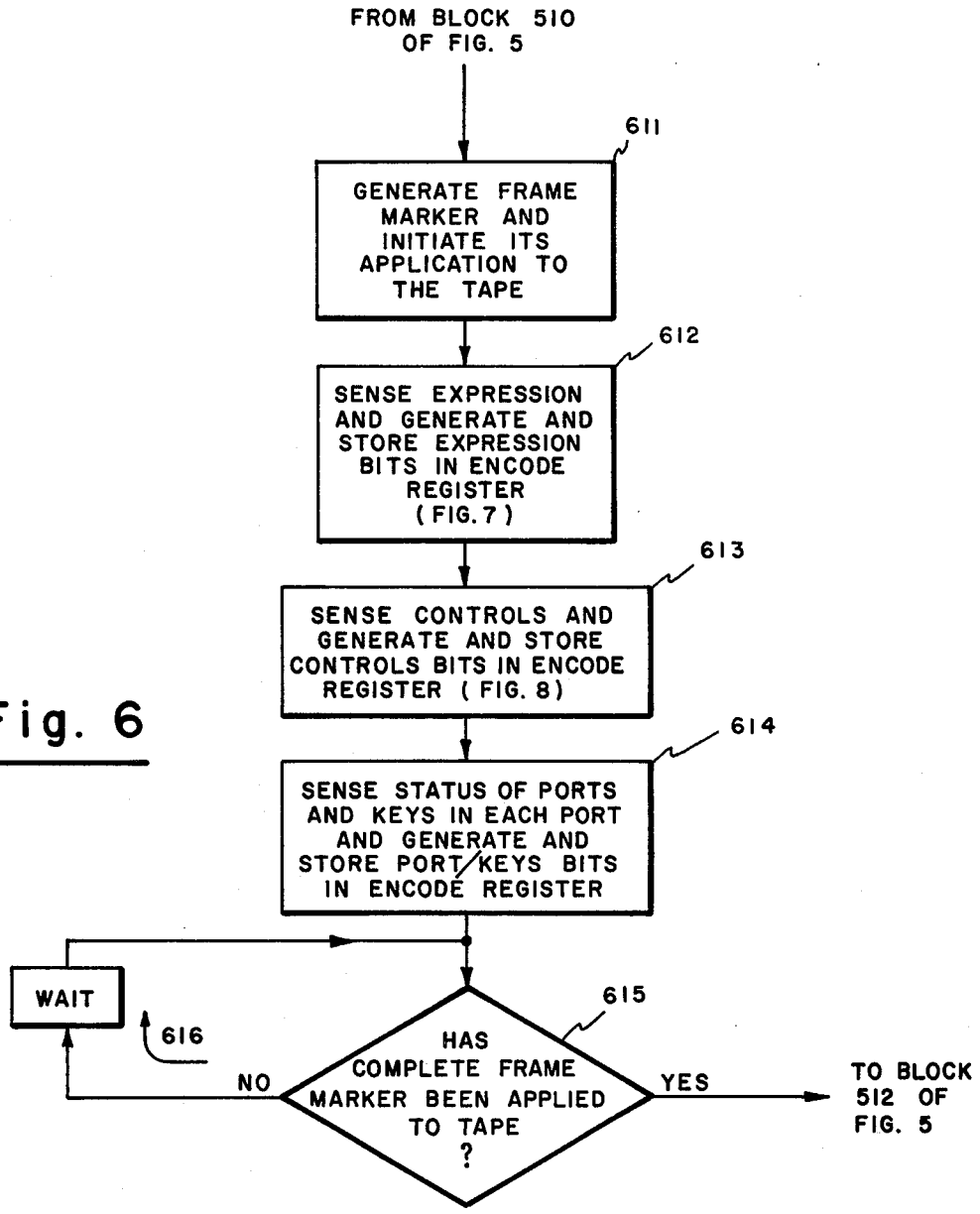
FIG. 6 is a flow diagram suitable for controlling the microprocessor and the associated circuitry of FIG. 1 to perform the encoding operation of the invention.

Referring to FIG. 6, there is shown a flow diagram suitable for controlling the microprocessor 50 and associated circuitry of FIG. 1 to perform the encoding operations of the invention. A frame marker for the next frame is generated (by the interface circuitry 80 of FIG. 1, to be described) and applied to the tape, as represented by block 611. In the present embodiment, the framemarker is four cycles of the lowest frequency applied to the tape; i.e., four cycles of 2 KHz signal. From beginning to end, this four cycles takes two milliseconds and, during this two milliseconds, the body of the frame is encoded and stored in the encode register. In this manner, the data bits of the frame are ready to be sequentially read out and stored on the tape at the completion of the frame marker. Thus, after initiation of the writing of frame marker on the tape, block 612 is entered, this block representing the routine for sensing the instrument loudness or expression and the storage of the expression-representative frame bits in the encode register. This routine is described in detail in conjunction with FIG. 7 hereinbelow. The block 613 is next entered, this block representing the routine for sensing the status of those stops, switches, etc. which are encoded into the "controls" bits part of the frame, and the storage of these bits in the encode register. This routine is described below in conjunction with FIG. 8.

After the controls bits have been stored in the encode register, none or one or more units of port/keys bits are generated and stored in the encode register, as represented by block 614. The routine of block 614 is described in further detail hereinbelow in conjunction with FIG. 9. Briefly, the port/keys bits are obtained by determining which ports have active keys and storing the index number of those ports along with indications of which keys in the ports are the active ones.

The diamond 615 is next entered, this diamond representing an inquiry or test as to whether the frame marker has been completely applied to the tape. If not, the wait loop 616 is entered until completion of the writing of the frame marker on the tape. When this event is complete, block 512 of FIG. 5 is entered and the data bits of the frame are serially applied from the encode register to the tape.

Figure 7:
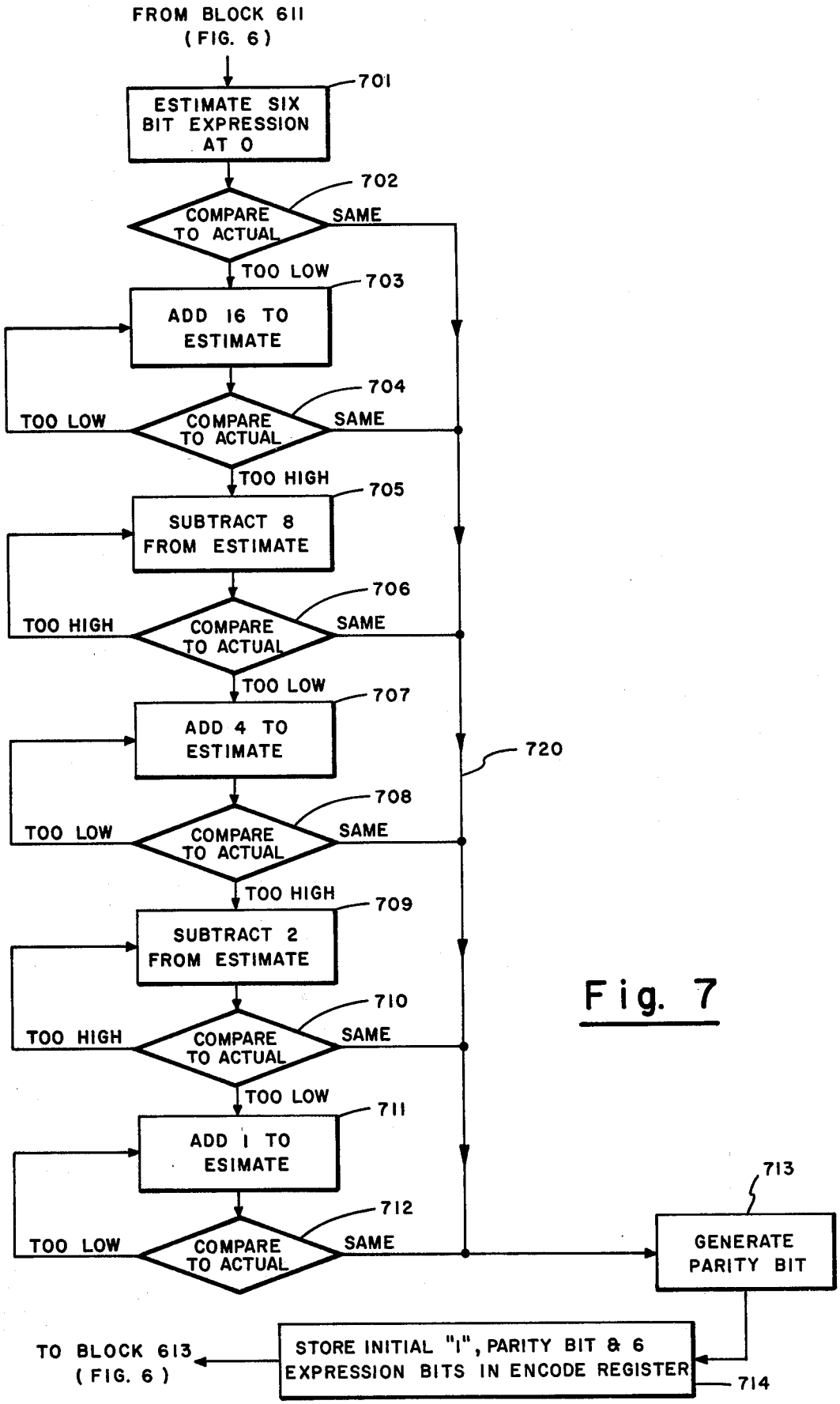
FIG. 7 is a flow diagram of the routine for generating the eight expression bits of a frame in accordance with an embodiment of the invention.

Referring to FIG. 7, there is shown a flow diagram of the routine for generating the eight expression bits of a frame. Six of these bits are a digital representation of the expression level, one is a parity bit, and another is a "transition bit" (that is always a "1", as noted above, to prevent transition from the lowest (frame marker) frequency to the highest ("0") frequency. An initial six bit estimate of the expression is selected as zero level; i.e., "000000", as represented by block 701. This value converted to an analog value (by D/A converter 75 of FIG. 1) and compared to the existing expression level (using comparator 70 of FIG. 1) as represented by diamond 702. If the values are substantially the same (this being defined as the values being within a specified range of each other), then branch 720 taken, this branch being used throughout the routine when the current estimate is essentially equal to the expression level. If the estimate is too low, however, block 703 is entered and 16 (in binary form, as is the case throughout this routine) is added to the estimate. The new estimate is then compared to the actual expression, as represented by diamond 704. If they are substantially the same, branch 720 is taken, whereas if the estimate is too low, block 703 is re-entered and an additional 16 is added to the estimate. This continues until either the estimate substantially corresponds to the actual expression, or the estimate becomes too high, whereupon block 705 is entered. The estimate is then reduced by 8 and tested (diamond 706), as before. Once again, the process is either repeated or coincidence is found (branch 720). If the estimate becomes too low, block 707 is entered and the estimate is increased by 4. Comparison with the actual expression is then again made (diamond 708), with the situation being analagous to the ones above. Subsequent successive approximations, implemented by subtracting 2's and adding 1's to the estimate, are implemented via block 709, diamond 710 (and the associated loop), and block 711, diamond 712 (and the associated loop). At some stage, when the estimate substantially equals the actual expression, the branch 720 is taken and the parity bit for the current estimate is then generated (block 713). The block 714 is then entered and the total of eight expression bits are caused to be dumped into their positions in the encode register, with a transition "1" in the first bit position, the parity bit in the second bit position, and the current six bit estimate in the last six bit positions. The encode register may be, for example, a serial-in-parallel-out register within circuirty 50, 51, 52 of FIG. 1, or it may be an allocated memory location in RAM.

Figure 8:
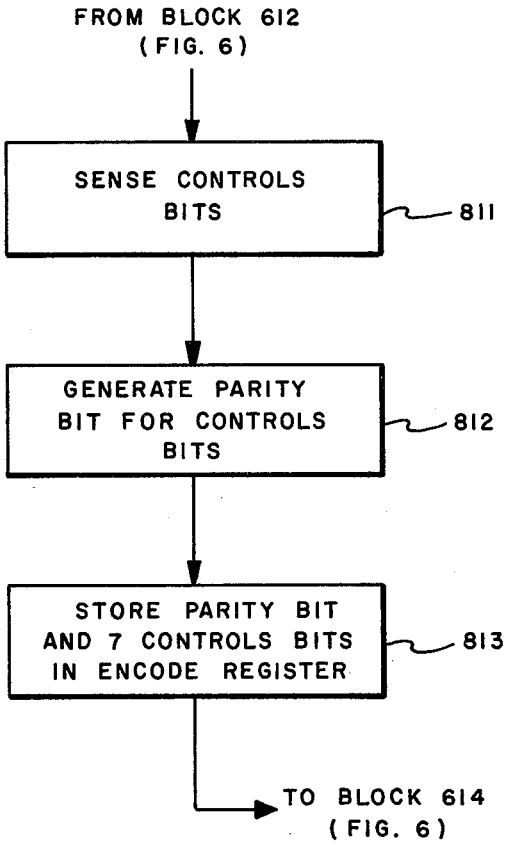
FIG. 8 is a flow diagram of the routine for obtaining and storing the "controls" bits of a frame being generated.

Referring to FIG. 8, there is shown a flow diagram of the routine for obtaining and storing the eight "controls" bits of the frame being generated. The controls bits are sensed (block 811) and a parity bit is generated for the controls bits (block 812). The parity bit and the seven informational control bits are then stored in the next eight positions of the encode register, as represented by block 813. Block 614 of FIG. 6 is then entered.

Figure 9:
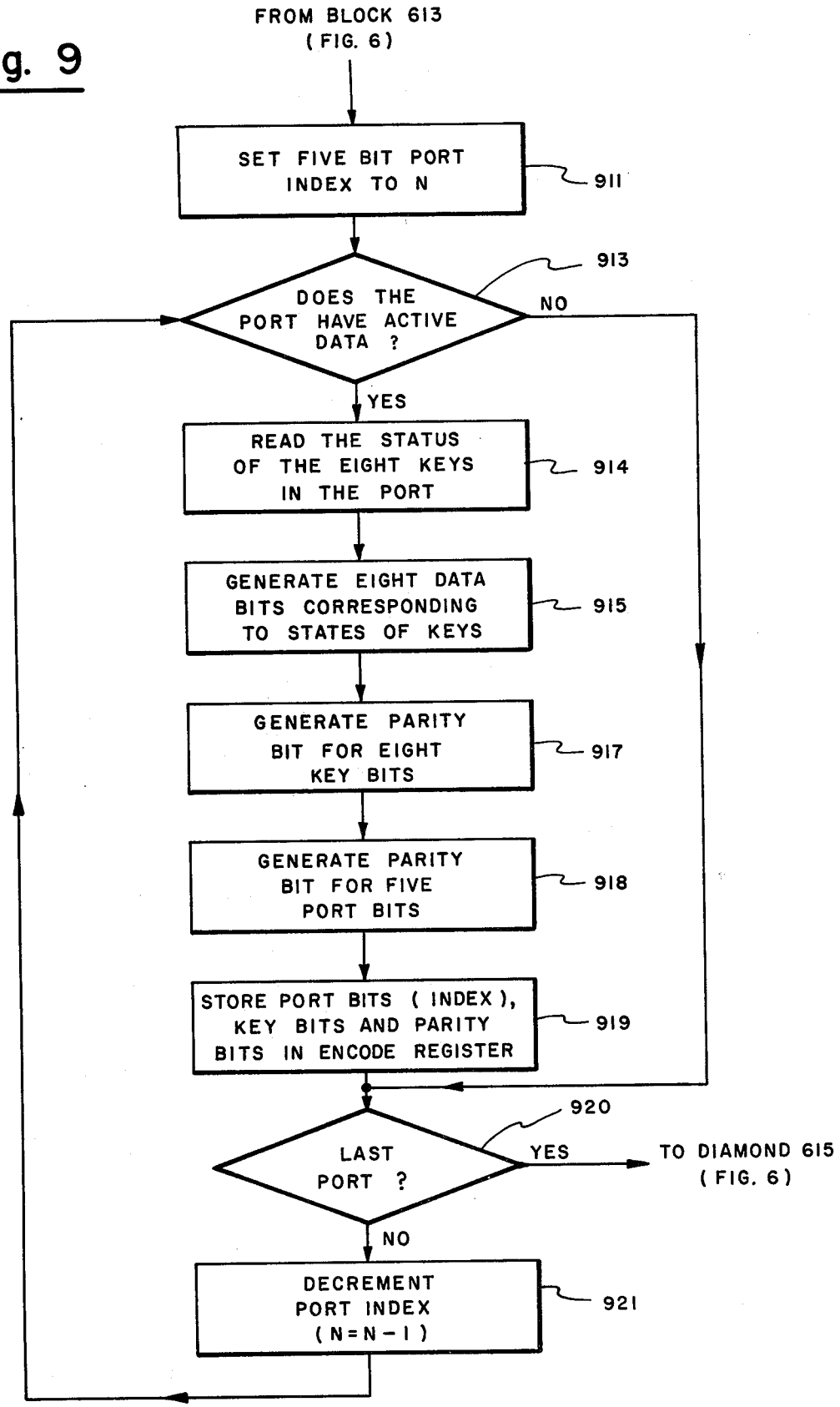
FIG. 9 is a flow diagram of the routine for obtaining and storing the none, one, or more units of port/keys bits of the frame being generated.

Referring to FIG. 9, there is shown a flow diagram of the routine for obtaining and storing the none, one, or more units of port/keys bits of the frame being generated. Block 911 is entered from the block 613 of FIG. 6. A five bit port index is initially set to N; i.e., the highest port number. In the present embodiment the port index numbers for the keyboard range from one through 24 (although 32 ports are theoretically possible using 5 bits, as noted above). Diamond 913 is next entered and a determination is made as to whether the port has any active data; that is, whether any of the keys in the port are activated at this particular sensing time. This is determined by scanning the input gates 40 (FIG. 1). When the port has no active keys, diamond 920 is entered directly. If, however, the port does have active data, the status of the eight keys in the port are read (block 914) and eight data bits are generated (block 915) corresponding to the active/inactive status of the keys. The parity bit is then generated for the eight key bits (block 917), and a parity bit is also generated (block 918) for the five port bits. The port bits (as represented by the port bit index), the key bits, and the parity bits are then stored in the stated order, in the encode register. A test is then made (diamond 920—which was also entered directly if the port had no active data) to determine if the last port (which will be port No. 1 in the present embodiment) has been reached. If not, the port index is decremented (block 921) and diamond 913 is re-entered. The procedure is continued until the last port is reached, whereupon diamond 615 of FIG. 6 is entered. It will be understood that a unit of 15 port/keys bits will accordingly be stored in the encode register for each port having one or more active keys.

Figure 10:
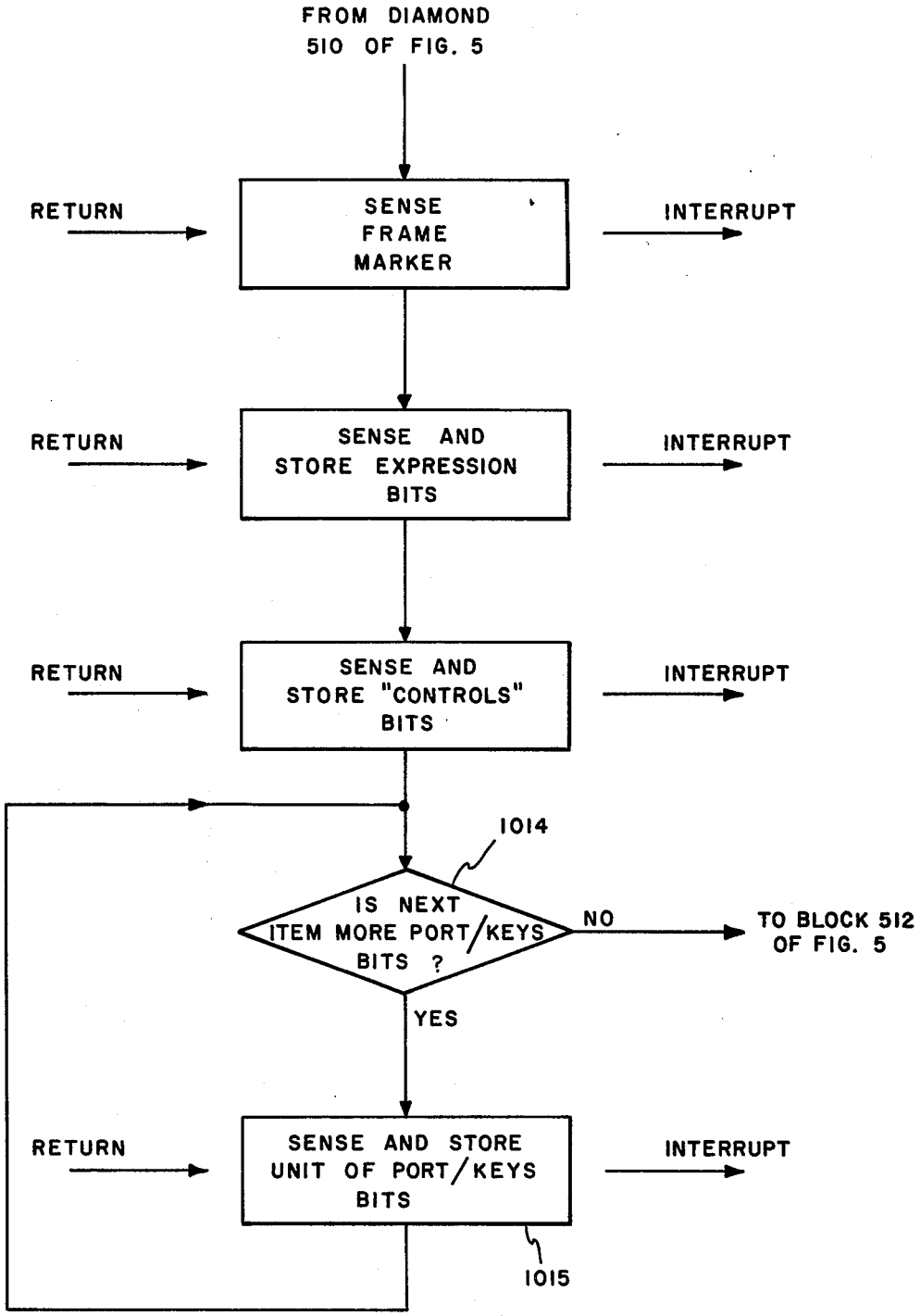
FIG. 10 is a flow diagram which is useful in understanding the general procedure of syntax decoding the information obtained from the tape.

Referring to FIG. 10, there is shown a flow diagram which is useful in understanding the general procedure of decoding the information obtained from the tape. The operational aspects of the various functions shown in FIG. 10 are set forth in conjunction with FIGS. 11–16 which describe the operational routines themselves. Accordingly, the purpose of FIG. 10 is to enhance overall understanding of the procedure during decoding. Block 1011 (entered from diamond 510 of FIG. 5 when the decode mode is operative) represents the sensing of the frame marker signal which determines the beginning of a new frame. When the frame marker has been received, block 1012 is entered and the expression bits are sensed and stored, these being the first data bits of the frame. Next, block 1013 is entered, this block representing the sensing and storing of the "controls" bits, which are next in order in the frame. Decision diamond 1014 is then entered, this diamond representing the determination as to whether the next item is more port/keys bits. As described above, a frame may have none, or one, or more units of port/keys bits. Accordingly, if, at the end of the "controls" bits, the next received information is a binary number, this indicates that a unit of port/keys bits comes next. On the other hand, if a cycle of frame marker signal is the next item received, this indicates that a new frame is beginning. In terms of FIG. 10, if more port/keys bits are evidenced, block 1015 is entered, this block representing the sensing and storage of the unit of port/keys bits (i.e., 15 bits for this embodiment). Diamond 1014 is then re-entered and the determination is made as to whether another unit of port/keys bits will follow, or whether a new frame follows. When a frame marker is indicated as being next, block 512 of FIG. 5 is re-entered, this block representing the application of the decoded bits (which are now in the decode register by virtue of the described functions of FIG. 10) to the control latches 40 of FIG. 1 and to the expression control 20 of FIG. 1. As indicated by the arrows to the right and left of the blocks in FIG. 10, the functions of sensing and storing the frame marker and the groups of bits in each frame are continuously interrupted by the arrival of new information. Return to the task at hand is then effected, as will become clear from description of the subsequent operational flow diagram.

Figure 11:
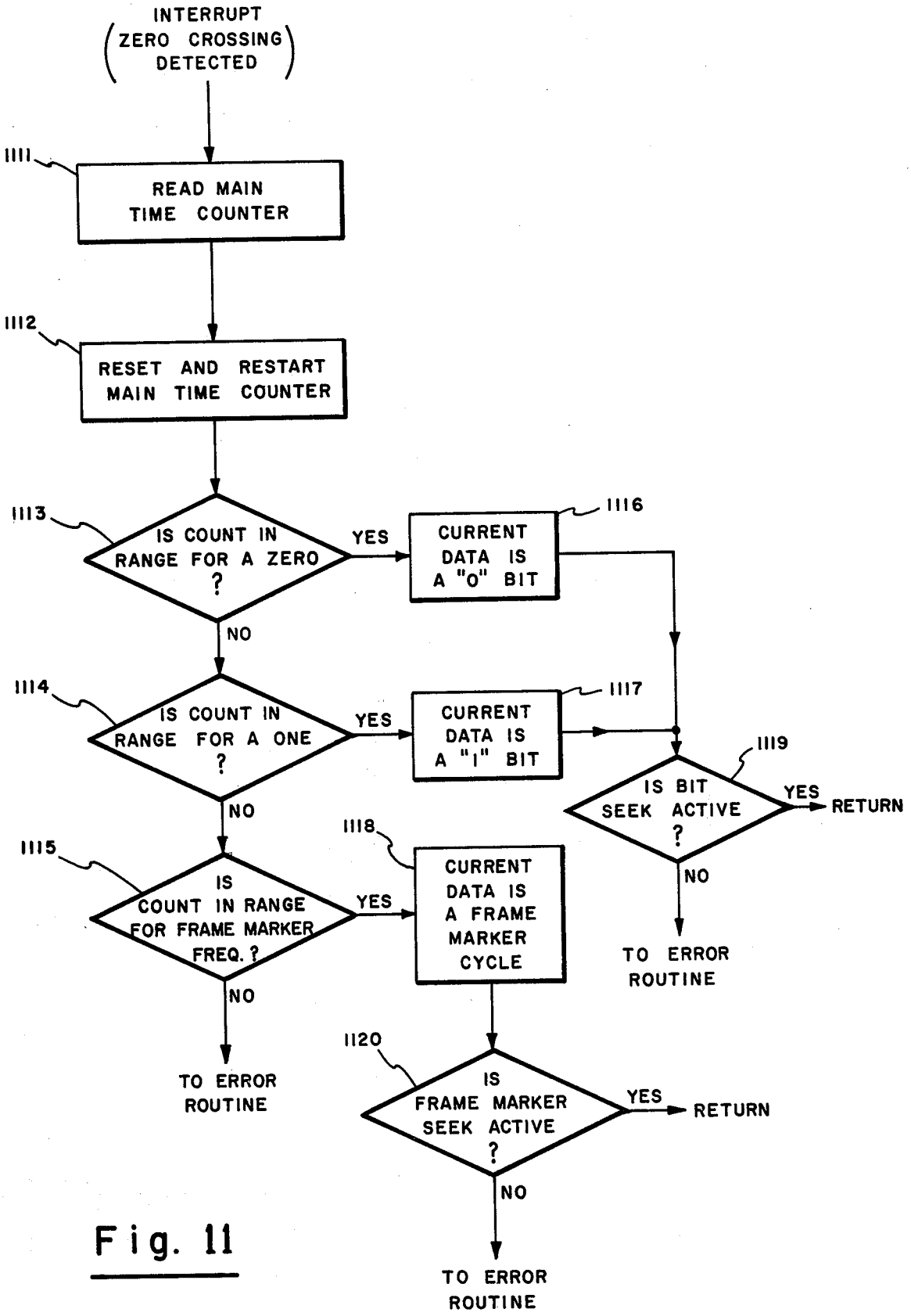
FIG. 11 is a flow diagram which defines operation of the interrupt routine of an embodiment of the invention.

Referring to FIG. 11, there is shown a flow diagram which defines operation of the "interrupt" routine which is operative when a negative-going zero-crossing is detected by a zero-crossing detector in the interface 80 (FIG. 1), each such zero-crossing indicating the occurrence of a frame marker, a "1" data bit, a "0" data bit, or an error. In other words, when a new piece of information is received, the general procedure of FIG. 10 is interrupted, and the interrupt routine of FIG. 11 is used to determine the nature of the new piece of information. The particular task being performed in the decode routine is then returned to.

The information being read from the tape is in frequency shift keyed form, so the determination of the frequency of the most recent signal cycle from the tape can be obtained by measuring the period of that last cycle. For example, since the frame marker frequency is 2 KHz, one would expect a period of about 0.5 milliseconds. Similarly, the expected periods for the "1" and "0" data bits would be 0.25 milliseconds and 0.125 milliseconds, respectively. As will be described further hereinbelow, the frequency shift of the signal read off the tape will be occurring at negative-going zero crossings of the signals read from the tape. Accordingly, at each negative-going zero crossing a "main time counter" is started and runs until the next negative-going zero crossing is detected. The elapsed time can then be categorized as to whether the last signal cycle was representative of a "frame marker" cycle, "1" data bit, or a "0" data bit. If the measured time is not within a reasonable range of the expected elapsed times for these items, then information for that cycle is characterized as an error.

In FIG. 11, block 1111 is entered upon occurrence of a negative-going zero-crossing, and the time of the main time counter (which had been started at the previous negative-going zero-crossing) is read. Block 112 is then entered, this block representing the resetting and restarting of the main time counter. A series of decision diamonds 1113, 1114, and 1115 are then entered, these diamonds successively representing tests to determine if the just-read count is in the range for a "0" (diamond 1113), a "1" (diamond 1114), or a cycle of "frame marker" signal (diamond 1115). In each case if the count is in the appropriate range, the "yes" branch of the decision diamond is taken. Thus, if the count is in a range established for a "0", block 1116 is entered and the current data is tagged as a "0" bit. Similarly, if the count is in the range established for a "1", block 1117 and the current data is tagged as a "1" bit. In either case, decision diamond 1119 is then entered and a determination is made as to whether "bit seek" is active. "Bit seek" is a flag that is set when binary data bits are being sought, as will be clarified hereinbelow. If binary data bits were, indeed, being sought, then the "yes" branch indicates a "return" to whatever task was being performed. The "return" is to a "return address" which, as will be seen, is determined by the particular task being performed. If the "bit seek" flag was not set, however, the determination of the current information as a binary bit would be indicative of an error, and the error routine (FIG. 16) would be entered.

If the main time counter indicates that the count is in the range for a cycle of frame marker frequency, block 1118 is entered and the current information is tagged as a frame marker cycle. Diamond 1120 is then entered and determination is made as to whether "frame marker seek" is active; i.e., whether or not a frame marker is expected to occur at this point. If so, "return" is effected and, if not, the error routine is entered. Similarly, if the count was not within any of the prescribed ranges, the error routine is entered via the "no" branch of diamond 1115.

Figure 12:
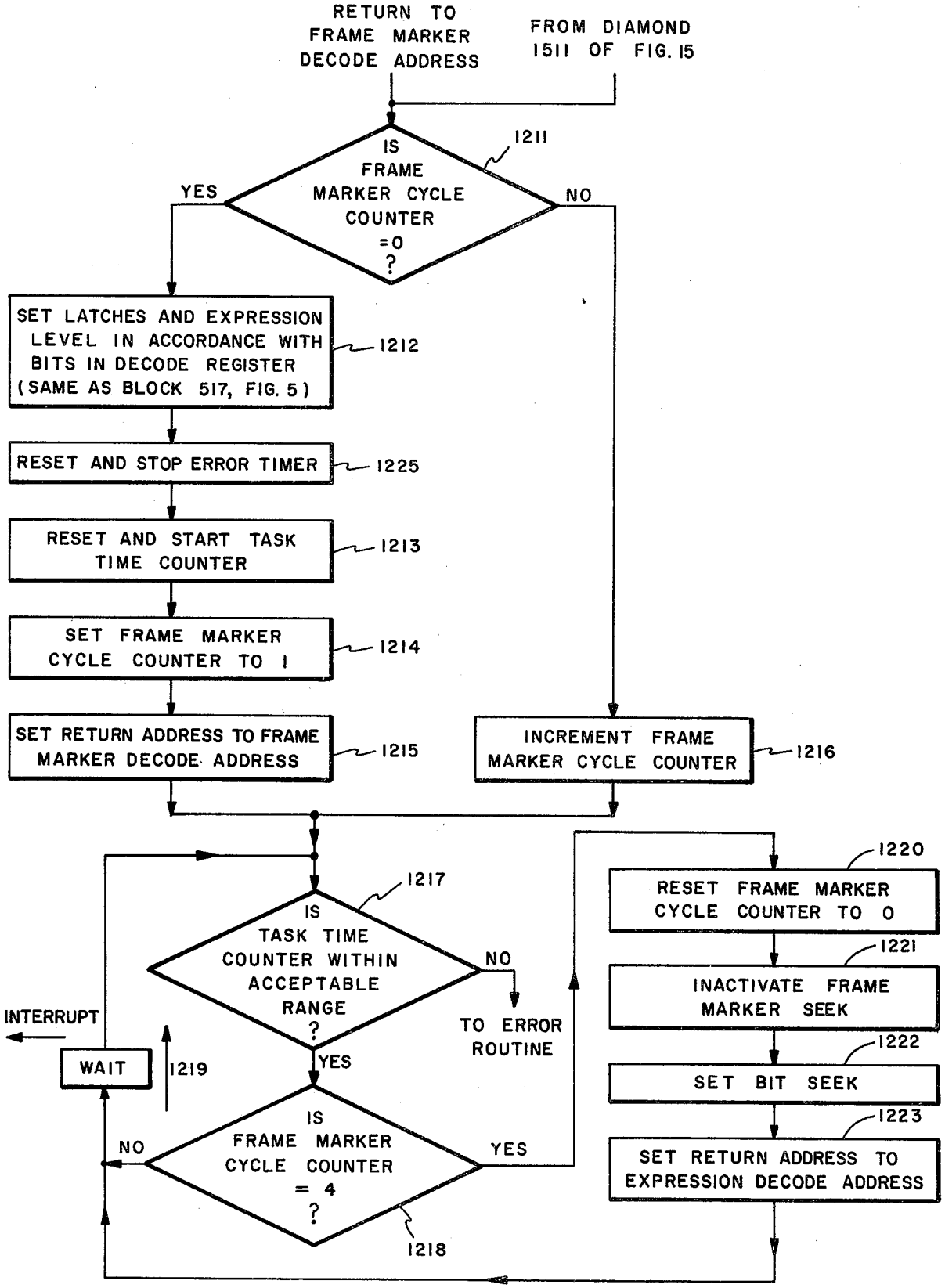
FIG. 12 is a flow diagram of the routine for sensing a frame marker in accordance with an embodiment of the invention.

Referring to FIG. 12, there is shown an operational flow diagram of the routine for sensing a frame marker. The routine of FIG. 12 is entered either when it has been determinded that a possible frame marker is just starting (this entry being from diamond 1511 of FIG. 15, to be described) or that a frame marker is in the process of being detected (in this case the routine of FIG. 12 being entered by return from the interrupt routine via a return address called "frame marker decode address"). In either event, diamond 1211 is initially entered, and a test is made as to whether a frame marker cycle counter is equal to zero. As previously noted, the frame marker of the present embodiment consists of four cycles of 2 KHz signal, and the frame marker cycle counter is used to keep track of the number of cycles of 2 KHz signal that have arrived so far. As will be seen, this frame marker cycle counter is initially set to zero (block 1220 to be described below) and the block 1212 is entered. Block 1212 corresponds in function to the block 517 of overall basic flow diagram of FIG. 5; i.e., it represents the setting of output latches 60 and the control of the expression control 20 in accordance with the bits in the decode register. In other words, these latches and the expression control are set in accordance with the data decoded from the frame which has just been completed. An error timer, to be described below in conjunction with FIG. 16, is reset to zero and stopped (block 1225). Block 1213 is then entered, this clock representing the resetting and starting of the task time counter for detection of a frame marker. As used in this and other routines, the task time counter establishes the maximum time which can be spent "looking" for a particular item (e.g., a frame marker, a group of expression bits, a group of "controls" bits, a unit of port/keys bits). As will be seen, if the task is not completed within the prescribed task time originally set on the counter, then an error condition is evidenced. The block 1214 is next entered, this block representing the setting of the frame marker cycle counter to 1, this being done since the "yes" branch output of diamond 1211 had indicated that the first cycle of frame marker signal is the one being processed. The block 1215 is next entered and the return address (for the interrupt routine) is set to "frame marker decode address" so that the upon subsequent interruption (to detect subsequent cycles of frame marker signal), the present FIG. 12 routine will be returned to.

If the frame marker cycle counter had not initially been zero, block 1216 would have been entered via the "no" output branch of diamond 1211, the block 1216 representing the incrementing of the frame marker cycle counter. Decision diamond 1217 is next entered, and a test is made as to whether the task time counter is within the prescribed acceptable time. If not, the error routine is entered. Otherwise, diamond 1218 is entered and determination is made as to whether the frame marker cycle counter is equal to four. If not, the wait loop 1219 is entered and the next interrupt is awaited. If, however, the frame marker cycle counter has reached four, a full frame marker is known to have been received. In this event, block 1220 is entered, this block representing the resetting of the frame marker cycle counter to zero. Since the frame marker is no longer being sought, the "frame marker seek" flag is inactivated (block 1221) and the "bit seek" flag is set (block 1222) since the data bits of the frame will now be sought. The block 1223 is then entered, this block setting the return address to the "expression decode address" so that subsequent interrupts will return to the expression decode routine of FIG. 13. The wait loop 1219 is then entered and the next interrupt is awaited.

Figure 13:
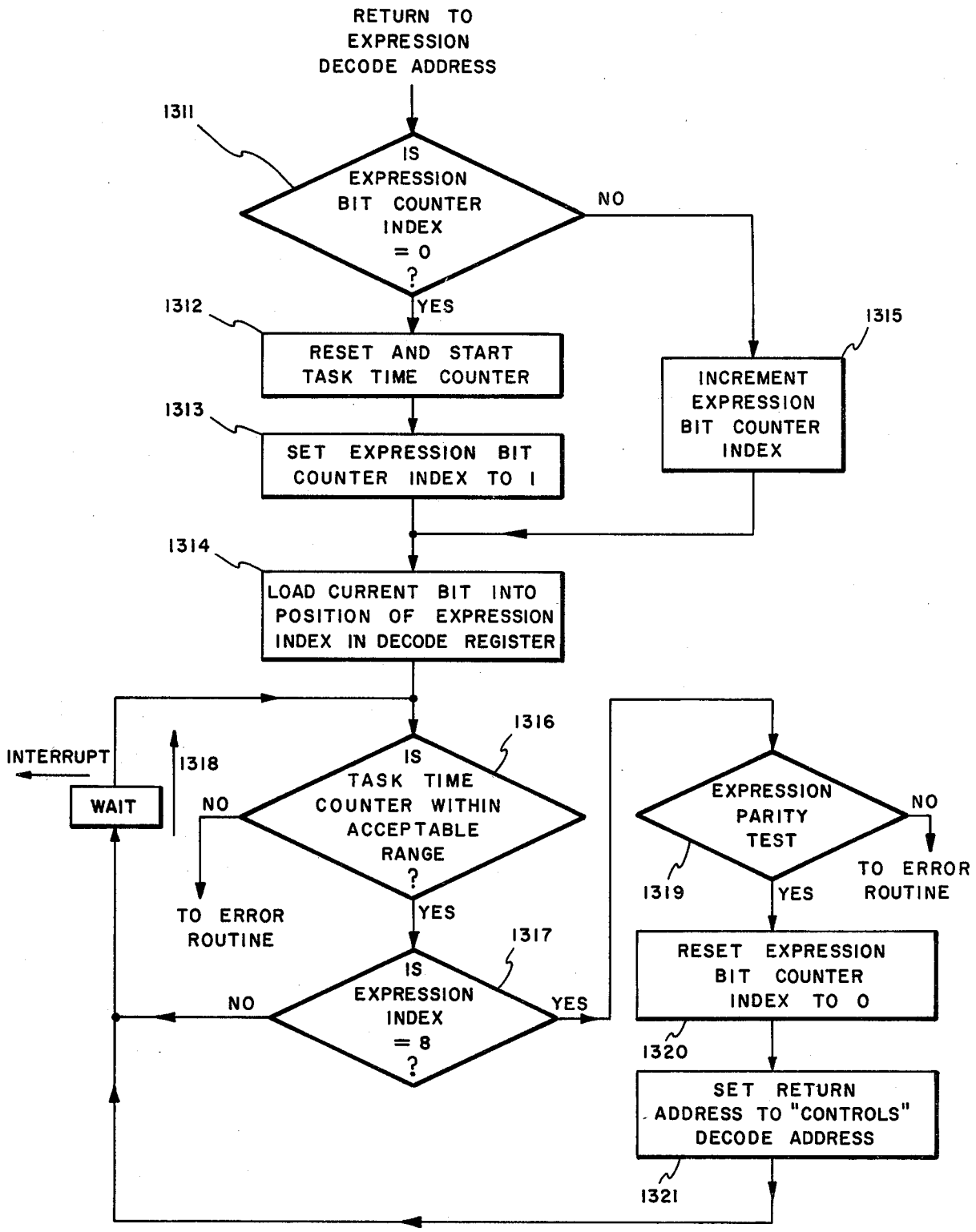
FIG. 13 is a flow diagram of the routine for sensing and storing, in the decode register, the expression bits in accordance with an embodiment of the invention.

FIG. 13 illustrates the routine for sensing and storing, in the decode register, the expression bits. The return address had been set (block 1223 of FIG. 12) to "expression decode address", as just described, so the next return from the interrupt (with the first data bit) will cause entry to diamond 1311. Determination is initially made as to whether the expression bit counter index is zero. The expression bit counter index is used to keep track of which one of the data bits of the group of eight expression bits is being processed, and is also used for locating the position in the decode register into which the current bit is to be loaded. This expression bit counter index is initially set at zero (block 1320 to be described below). When the bit counter index is found to be zero, block 1312 is entered, this block representing the resetting and starting of the task time counter for the present task. The expression bit counter index is next set to one (block 1313). Block 1314 is then entered, this block representing the loading of the current bit into position in the decode register which is determined by the expression bit counter index. Thus, for example, if this is the first expression bit (expression bit counter index equals 1) then the bit will be properly loaded into the first data bit position for the frame. If the expression bit counter index had not initially been zero, the "no" output branch of diamond 1311 would have entered the block 1314 via block 1315 which represents the incrementing of the bit counter index.

After the loading of the current bit, diamond 1316 is entered, this diamond representing the test as to whether the task time counter is within acceptable range. If not, the error routine is entered. Otherwise, the diamond 1317 is entered, this diamond representing a test as to whether the expression index to eight. If not, the wait loop 1318 is entered and the next interrupt is awaited. If, however, the expression index equals eight, this means that the eight expression bits have been received and loaded into the decode register. Diamond 1319 is then entered, and the expression parity is tested, the error routine being entered if the parity test fails. Next, the block 1320 is entered, this block representing the resetting of the expression bit counter index to zero. The return address is then set to "controls decode address" since the interrupt routine should next return to the routine of FIG. 14 for processing of the controls bits. The wait loop 1318 is then entered and the next interrupt is awaited.

Figure 14:
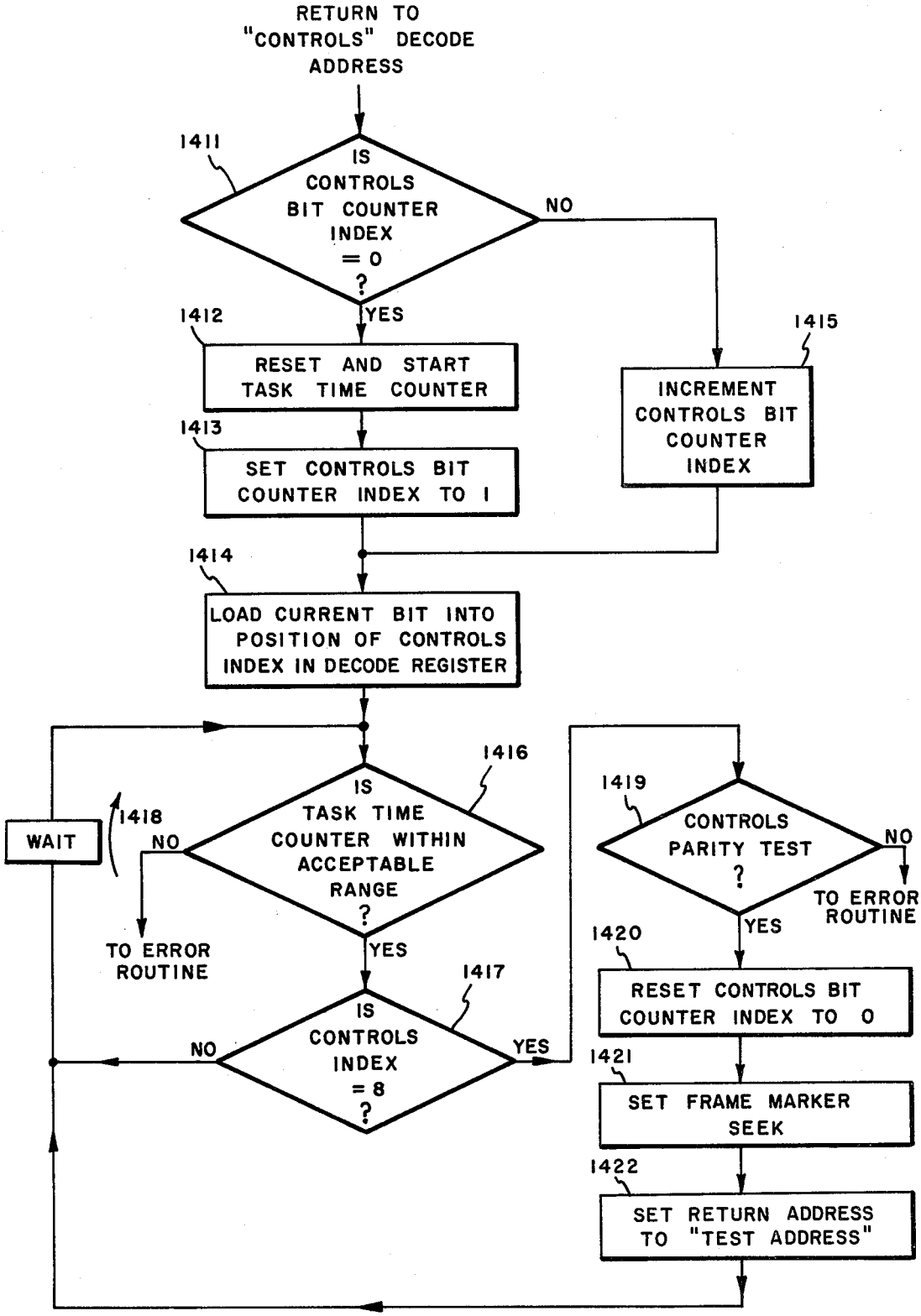
FIG. 14 is a flow diagram of the routine for sensing and loading, into the decode register, the "controls" bits of a frame in accordance with an embodiment of the invention.

The flow diagram of FIG. 14, which is concerned with the sensing and loading, into the decode register, of the "controls" bits of the frame, is quite similar to the routine of FIG. 13. In the flow diagram of FIG. 14, the diamond 1411 is entered by return from the interrupt routine to the just-set "controls decode address". Operation of blocks 1411 through 1420 is then similar to operation of the corresponding blocks 1311 through 1320 of FIG. 13, and for a similar purpose; viz., to handle the eight bits which are the next group of bits in the frame being decoded. When the task of block 1420 has been completed, block 1421 is entered and the "frame marker seek" flag is set. As will be recalled (see e.g. FIG. 2 and FIGS. 3A and 3B), after the "controls" bits, the next information will be either a frame marker for the next frame (in the event there are no port/keys bits) or the first bit of a first unit of port/keys bits. Since the "bit seek" flag is already set (recall block 1222 of FIG. 12), the operation of block 1421 allows either a digital bit or a frame marker cycle to be sought. The block 1422 is then entered, this block representing the setting of the return address to an address called "test address". This return address indicates a return to the diamond 1511 of FIG. 15 (to be described next) which is used to determine whether the next received information is the beginning of a new frame marker or the beginning of a unit of port/keys bits.

Figure 15:
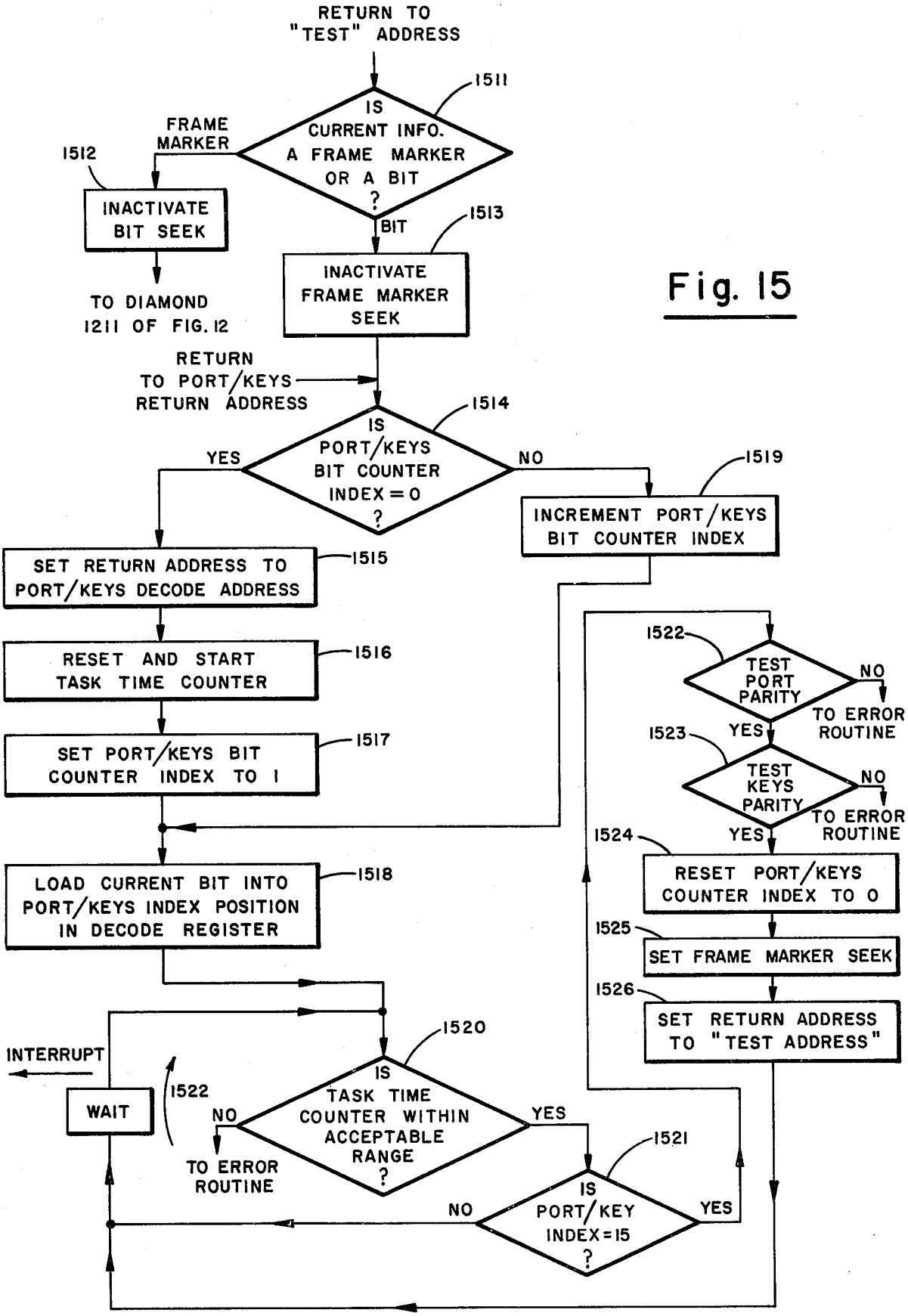
FIG. 15 is a flow diagram of the routine for sensing and loading, into the decode register, the none, one, or more units of port/keys bits of a frame in accordance with an embodiment of the invention.
Figure 16:
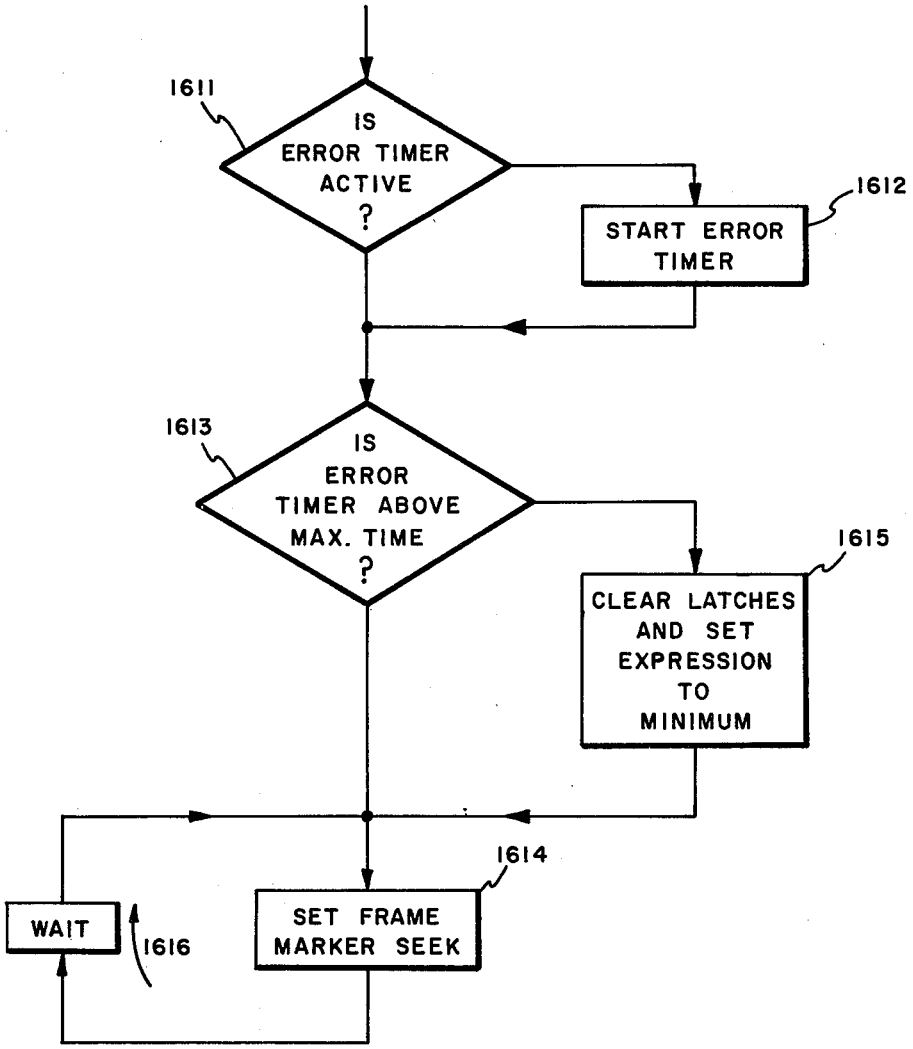
FIG. 16 is a flow diagram of the error routine in accordance with an embodiment of the invention.

Referring to FIG. 15, a test is initially made as to whether the current information is the beginning of a frame marker or a data bit. If it is the beginning of a frame marker, the "bit seek" flag is inactivated (block 1512) and diamond 1211 of FIG. 12 is entered. If, however, the current information is a data bit, block 1513 is entered and the "frame marker seek" flag is inactivated. A test is then made (diamond 1514) as to whether the port/keys bit counter index is equal to zero; i.e., whether this is the first bit of a unit of port/keys bits. If so, the return address is set to "port/keys decode address" (block 1515) so that the interrupt routine will return to diamond 1514 (as seen in the FIGURE) while the port/keys are being received. The task time counter for the task at hand is then reset and started (block 1516), and the port/keys bits counter index is set to one (block 1517). The block 1518 is then entered (or is entered from the "no" branch of diamond 1514 via block 1519 which increments the port/keys bit counter index if the first bit is not being processed), block 1518 representing the loading of the current bit into the port/keys index position in the decode register. Diamond 1520 is then entered and the task time counter is checked. The port/key index is then tested to see if the last bit (bit 15) has been reached, as represented by diamond 1521. If not, the wait loop 1522 is entered and the next interrupt is awaited. If the port/key index has reached 15, diamond 1522 is entered and the port parity is checked. The keys parity is then checked (diamond 1523) and the error routine is entered if either parity test is failed. If not, the block 1524 is entered, this block representing the resetting of the port/keys counter index to zero. The situation is now analogous to that which occurred when block 1421 of FIG. 14 was entered; i.e., the next information can be either the beginning of a new frame marker or a further unit of port/keys bits. Accordingly, as before, the "frame marker seek" flag is set (block 1525) and the return address is then set to "test address". The wait loop 1522 is then entered to await the next interrupt.

It can be seen that activity will continue in accordance with the routine of FIG. 15 until all units of port/keys bits have been input into the decode register. The next frame marker will then be received and diamond 1211 of FIG. 12 will be entered.

In FIG. 16, there is shown a flow diagram of the error routine in accordance with the present embodiment of the invention. As was seen in description of previous routines, there are various situations which will cause entry into the error routine. For example, in FIG. 11, the data may not be identified as a zero, a one, or a frame marker, and will therefore be designated as an error. Further, in FIG. 11, it is seen that an error condition is evidenced if data is received when a frame marker is being sought, or vice versa. In routines of FIGS. 13, 14 and 15, parity bit errors may be detected, or an event may not occur within a prescribed time limitation, as explained in conjunction with the referenced FIGS.

In accordance with the present embodiment of the invention, an error during any particular frame (or when waiting for a frame) is treated by ignoring the erroneous information and having the instrument continue to play whatever was being played before the error occurred. In particular, when an error is sensed, no change is made (up to a certain point) in the status of output latches 60 (FIG. 1) so the instrument continues to play whatever it was playing before the error. In this manner, an error during a single frame (for example) will likely not be noticed, and even an error during a series of frames may not have a particularly disturbing effect. In the event that errors persist for a predetermined maximum time, the routine of FIG. 16 will cause the musical instrument to go silent by clearing the latches 60 and setting the expression control to its minimum value.

Referring specifically to the error routine of FIG. 16, diamond 1611 is initially entered, upon occurrence of an error, and determination is made as to whether an error timer is active. The error timer is used to determine whether errors are persisting over a predetermined period of time, so that the musical instrument can be turned silent after such predetermined time. When a meaningful frame of information is received, the error timer is reset to zero (see block 1225 of FIG. 12). If the error timer is not active (i.e., if this is the first error after a frame of good information), block 1612 is entered, this block representing the starting of the error timer. The diamond 1613 is then entered (and is also entered from the "yes" branch of diamond of 1611), and the error timer is tested to determine whether it is above the predetermined maximum time. If not, the block 1614 is entered directly, and "frame marker seek" is set so that the beginning of the next frame of information is awaited. The wait loop 1616 is then entered until the next interrupt occurs. Since no changes are made in the states of the output latches 60 (FIG. 1), the latches will remain latched in accordance with a previously received acceptable information, and until the next acceptable frame of information is received and processed. When no acceptable new information has been processed within the predetermined maximum time, the test of diamond 1613 will so indicate, and block 1615 will be entered. The block 1615 represents the clearing of the latches and the setting of the expression control (FIG. 1) to its minimum level.

Figure 17:
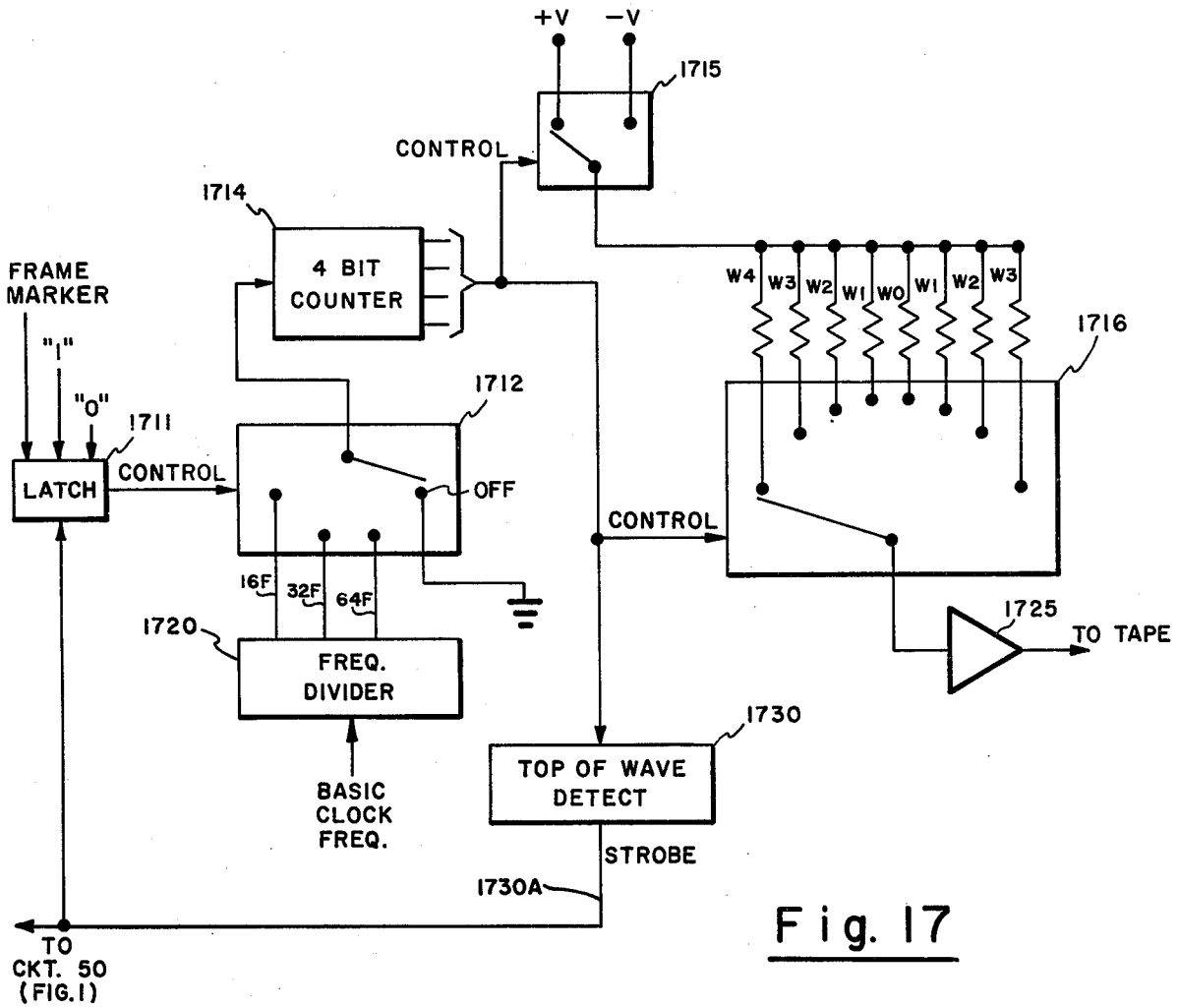
FIG. 17 is a block diagram of the portion of the interface of FIG. 1 utilized for generating digitally synthesized frequency shift keyed signals for application to the magnetic tape.
Figure 18A:
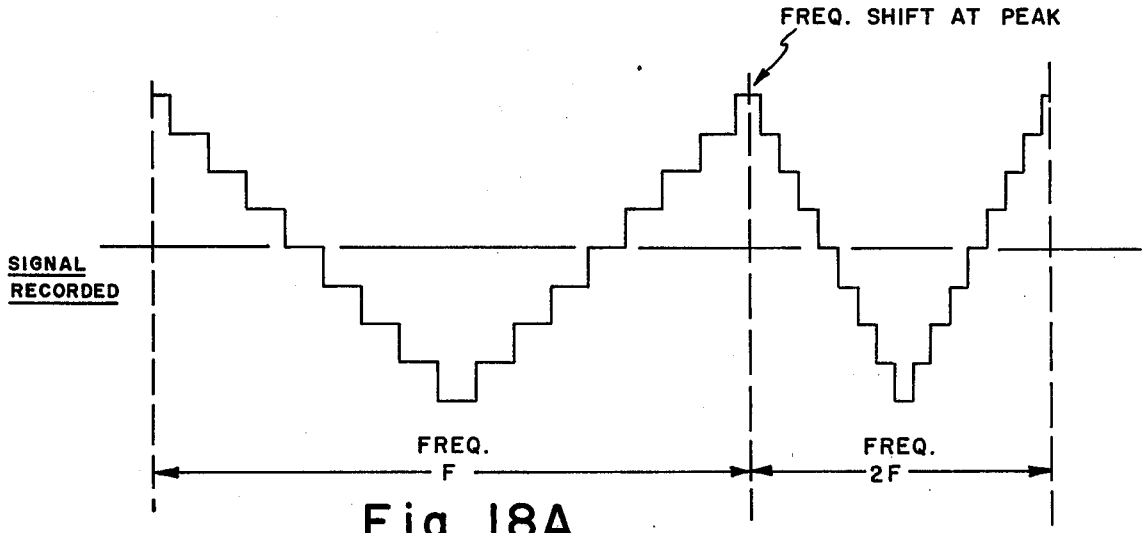
FIGS. 18A and 18B illustrate the nature of digitally synthesized frequency shift keyed sine waves which are, respectively, applied to the magnetic tape and recovered from the magnetic tape.

FIG. 17, shows a block diagram of the subsystem of interface 80 (FIG. 1) utilized in the present invention for generating the digitally synthesized sinusoid signals in frequency shifted keyed form, these signals being applied to the magnetic tape 90. As was illustrated in concept in conjunction with FIG. 4, the signals to be applied are representative of either frame marker cycles (frequency f), "1's" (frequency 2 f), or "0's" (frequency 4 f). To avoid the recording problems caused by higher frequency spectral components present in square waves, applicants utilize digitally synthesized sine waves (e.g., (FIG. 18A). For the signals applied to the tape, the frequency shift is implemented at the signal peak. A ninety-degree phase shift is inherent in the process of applying the frequency shift keyed signals to the tape and later recovering the signals (this phase shift actually resulting from differentiation of the signals, inherent in the magnetic tape recording/playback process, which, in the case of a sine wave, results in a ninety-degree phase shift). This means that when the signal is recovered upon playback, the frequency shift will occur at negative-going zero crossings of the signal, as is consistent with the decoding scheme. Also, it will be understood that if an unauthorized copy of the tape is made, an extra ninety-degree phase shift will result, and the signal read from a second generation tape will be unuseable with the existing decoding apparatus. This feature is therefore advantageous in preventing unauthorized tape reproduction.

Referring now to the structure of FIG. 17, the signal representative of "frame marker", "1", or "0" (from microprocessor 50) is coupled to a latch 1711 under control of a strobe signal 1730 A which is output from a circuit 1730, to be described. As will be recalled, four cycles of frame marker frequency (at a frequency f=2 KHz in this embodiment) are initially applied to the tape, the successive controls for these four cycles of 2 KHz signal being handled by the microprocessor 50 (FIG. 1) operated in accordance with the encode routine of FIG. 6, as previously described. The strobe signal 1730A is operative to indicate that the previous cycle of sinusoid has been applied to the tape and to call up the next information from the microprocessor 50 and its associated memories. In the case of the frame marker, the strobe indicates that the next cycle at 2 KHz is to be generated by the circuitry of FIG. 17, (this continuing until four cycles at 2 KHz have been generated). In the case of the data bits of a frame, the strobe is operative to sequentially call up successive data bits from the encode register. Accordingly, the latch 1711, upon issuance of the strobe signal, takes on one of three possible active output states depending upon whether the next information to be recorded is cycle of frame marker, a "0" data bit, or a "1" data bit. The latch then maintains one of its three active output states until it receives the next information upon occurrence of the next strobe signal. (It will be understood that the latch 1711 may be provided with an "off" state which will be effective during the decoding mode. The latch output is preferably a two line binary output, so the "off" state can be the fourth available latch output state.)

The output of latch 1711 controls a multiplexer (or selector) 1712 to select at its output one of three signals (or a fourth line, which represents the "off" state, such as during the decode mode). In the present embodiment, the three signals have respective frequencies of 16 f(equals 32 KHz), 32 f (equals 64 KHz), and 64 f (equals 128 KHz), bearing in mind that f=2 KHz. These frequencies are obtained by dividing a basic clock frequency of 2.048 MHz (which may be the basic clock frequency of the microprocessor) by 64, 32, and 16, respectively. As will become clear, the multiplier sixteen, i.e. the use of frequencies 16 f, 32 f and 64 f, whereas the actual frequency shift keyed frequencies are f, 2 f and 4 f) is employed since the digitally synthesized sinusoids are generated using eight steps per half-cycle. Frequency divider circuit 1720 provides 16 f, 32 f and 64 f.

The output of multiplexer 1712, which is at a frequency of either 32 KHz, 64 KHz or 128 KHz, is applied to a four bit counter 1714. The four bit counter 1714 counts to sixteen ($2^4$) and then recycles. The counter output is coupled to the control terminals of a 2×1 multiplexer or selector 1715 and to the control terminals of an 8×1 multiplexer or selector 1716. The counter output bits are also coupled to a "top of wave" detector 1730 which is operative to generate the strobe signal when a particular counter output ("0000" in this embodiment) is detected. The multiplexer 1715 selects either a voltage +V or −V, depending upon the status of its control signals (i.e., the output of four bit counter 1714). The output of multiplexer 1715 is coupled to the eight input terminals of multiplexer 1716 via the eight impedances having the illustrated referenced "weights" designated w0, w1, w3, w4, w3, w2 and w1. The "weighting" designations are for ease of illustration. Actually, the impedances have values which vary sinusoidally as one/eighth fractions of a sinusoidal signal. Thus, the w0 value is weighted as sin (0·180°), the w1 value is weighted as sin ($\frac{1}{8}$·180°), the w2 value is weighted as sin ($\frac{1}{4}$·180°), the w3 value is weighted as sin ($\frac{3}{8}$·180°), and the w4 value is weighted as sin ($\frac{1}{2}$·180°). The output of multiplexer 1716 is coupled to the tape via buffer amplifier 1725.

In the present embodiment, the 2×1 multiplexer 1715 is set to switch from positive to negative when the output of counter 1714 is "0100", and to switch from negative to positive when the output of counter 1715 is "1100". The 8×1 multiplexer is set to switch to the weighting values shown in the following table, for each possible output of counter 1715:

TABLE

| Count | Weight |
|---|---|
| 0000 | w4 |
| 0001 | w3 |
| 0010 | w2 |
| 0011 | w1 |
| 0100 | w0 |
| 0101 | w1 |
| 0110 | w2 |
| 0111 | w3 |
| 1000 | w4 |
| 1001 | w3 |
| 1010 | w2 |
| 1011 | w1 |
| 1100 | w0 |
| 1101 | w1 |
| 1110 | w2 |
| 1111 | w3 |

To illustrate the operation of the circuit of FIG. 17, assume that a frame marker indication has just been strobed into latch 1711. This will cause the latch output to control multiplexer 1712 to select the frequency 16 f (equals 32 KHz). The four bit counter 1714 will then start counting at the 32 KHz rate. The initial count of four bit counter 1714 is "0000", and the multiplexer 1715 is set to select the positive voltage +V (and has been so set since the count of 1100, as indicated above). During the first four counts of four bit counter 1714, the multiplexer 1716 cycles through the four decreasing impedance weights, w4, w3, w2 and w1, as can be seen from the TABLE, and as illustrated by the first four descending "steps" shown in FIG. 18A. The next output count, "0100" causes multiplexer 1715 to select −V (although for weight w0 the amplitude is zero, so sign is of no consequence). Subsequently, during the next eight counts, the voltage −V is applied to the inputs of multiplexer 1716. These eight counts from four bit counter 1714 cause the multiplexer 1716 to select the weightings, w0, w1, w2, w3, w4, w3, w2, and w1, and these values account for the next eight (negative) steps in the waveform of FIG. 18A. The next count, "1100" causes multiplexer 1715 to again select +V, and the last four steps of the waveform are formed, consistent with the TABLE and as shown in FIG. 18A.

The four bit counter 1714 will now have gone through a complete cycle of sixteen and now reaches the count "0000" which triggers the "top of wave" detector 1730. The resultant strobe signal will cause the next information to be read into latch 1711. In the illustration of FIG. 18A, the next cycle is at a frequency 2 f, as would result from the next information to latch 1711 being a "1". Thus, the frequency of the signal feeding four bit counter 1714 will be twice as high (64 KHz) as the previous case, but otherwise the operation of the multiplexers 1715 and 1716 will be as just described. It will be seen that in this manner successive cycles of digitally synthesized sinusoids are generated with the desired frequency shift (if any) being implemented at the wave peak.

Figure 18B:
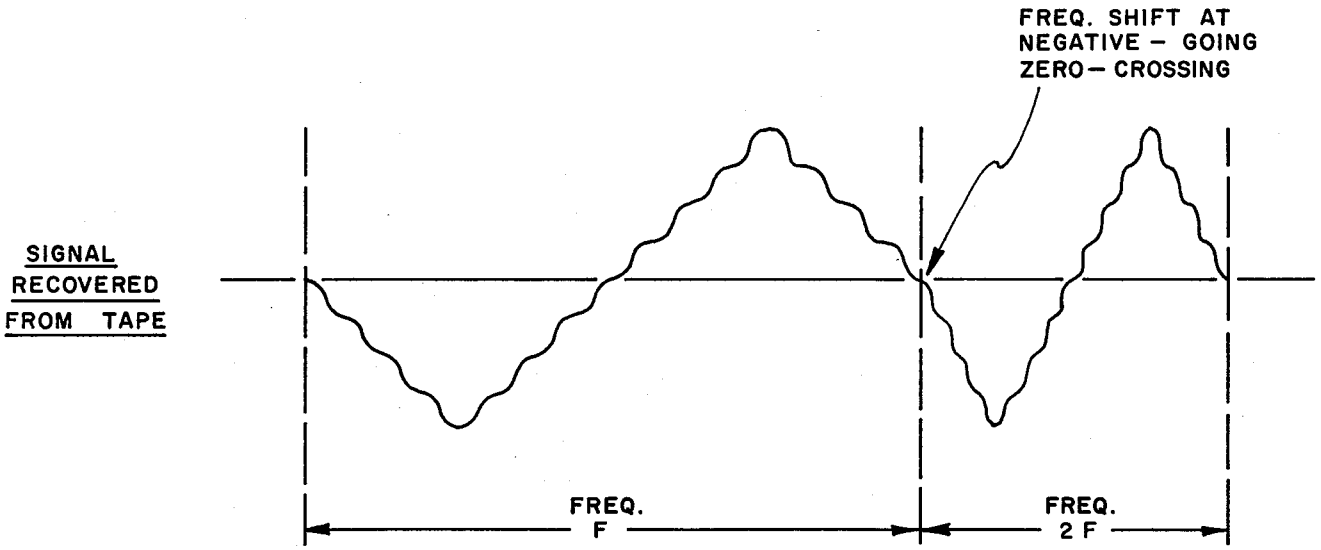

FIG. 18B shows the nature of the signal recovered from the tape, and it is seen that the differentiation caused by the recording process results in the frequency shifts occurring at negative-going zero crossings of the recovered signals. In the present embodiment the frequency shift is implemented at the waveform peak, and this results in the frequency shift occuring at negative-going zero crossings of the recovered signal. However, it will be understood that the frequency shift could be implemented at any desired reference point compatible with the detection scheme being used, and appropriate delays can also be intentionally added for use in conjunction with a given detection scheme.

The invention has been described with reference to a specific embodiment, but variations within the spirit and scope of the invention will occur to those skilled in the art. For example, while a general purpose microprocessor has been illustrated as performing logical functions in accordance with the principles of the invention, it will be understood that the invention could alternatively be practiced using other means, for example, hard wired logic. Also, the manner in which the instrument keys and controls are coupled to the processor (illustrated in FIG. 1 as being via input gates and output latches) is within the skill of the art and can be implemented by various alternative means. For example, in one working implementation of the present invention, the latches effectively control the switches 11 and 16 by providing a transistor switch (i.e., the latch drivers 65) in parallel with each mechanical switch. When the latch is set, the latch output closes the transistor switch thereby shorting the keyswitch so that the key is effectively "played" as if it had been pressed by a user. The input gates 40, on the other hand, are operative to sense the voltage at each key switch under control of the microprocessor, consistent with previous description.

We claim:

1. A musical keyboard instrument having an automatic playing capability, comprising:
   - a keyboard which includes a plurality of keys;
   - musical tone generators associated with said keys;
   - means for sensing, at a sensing time, which of the keys are activated;
   - means for generating a sequence of frames, each frame including digital information representative of the keys which are activated at a given sensing time, the duration of each frame being a function of the relative locations of the keys activated at the given sensing time;
   - each said sensing time being determined by the previously completed frame;
   - means for storing sequences of said frames;
   - means for reading out stored sequences of frames;
   - means for decoding the information in the read out frames; and
   - means for activating the tone generators in accordance with the decoded information.

2. The instrument as defined by claim 1, wherein said means for storing sequences of said frames comprises means for recording said frames on magnetic tape.

3. The instrument as defined by claim 1, wherein said keys are divided into groups and the digital information for each frame includes identification of the groups that have one or more activated keys and identification of the individual keys that are activated within each group.

4. The instrument as defined by claim 2, wherein said keys are divided into groups and the digital information for each frame includes identification of the groups that have one or more activated keys and identification of the individual keys that are activated within each group.

5. The instrument as defined by claim 1, wherein said digital information is encoded in frequency shift keyed form.

6. The instrument as defined by claim 3, wherein said digital information is encoded in frequency shift keyed form.

7. The instrument as defined by claim 4, wherein said digital information is encoded in frequency shift keyed form.

8. The instrument as defined by claim 5, wherein the code of said frequency shift keying is formulated with a first frequency representative of a frame marker, a second higher frequency representative of one binary state, and a third even higher frequency representative of another binary state.

9. The instrument as defined by claim 6, wherein the code of said frequency shift keying is formulated with a first frequency representative of a frame marker, a second higher frequency representative of one binary state, and a third even higher frequency representative of another binary state.

10. The instrument as defined by claim 7, wherein the code of said frequency shift keying is formulated with a first frequency representative of a frame marker, a second higher frequency representative of one binary state, and a third even higher frequency representative of another binary state.

11. The instrument as defined by claim 4, wherein the identification of each group having activated keys is in the form of a binary number representing the reference number of said group, and wherein the individual keys within each said group are represented by individual binary bits.

12. The instrument as defined by claim 7, wherein the identification of each group having activated keys is in the form of a binary number representing the reference number of said group, and wherein the individual keys within each said group are represented by individual binary bits.

13. The instrument as defined by claim 10, wherein the identification of each group having activated keys is in the form of a binary number representing the reference number of said group, and wherein the individual keys within each said group are represented by individual binary bits.

14. The instrument as defined by claim 4, wherein most of said groups have about eight keys therein.

15. The instrument as defined by claim 10, wherein most of said groups have about eight keys therein.

16. The instrument as defined by claim 13, wherein most of said groups have about eight keys therein.

17. The instrument as defined by claim 5, wherein said means for storing sequences of said frames comprises means for recording said frames on magnetic tape, said recording means including means for generating digitally synthesized sinusoidal signals for application to said magnetic tape.

18. The instrument as defined by claim 6, wherein said means for storing sequences of said frames comprises means for recording said frames on magnetic tape, said recording means including means for generating digitally synthesized sinusoidal signals for application to said magnetic tape.

19. The instrument as defined by claim 8, wherein said means for storing sequences of said frames comprises means for recording said frames on magnetic tape, said recording means including means for generating digitally synthesized sinusoidal signals for application to said magnetic tape.

20. The instrument as defined by claim 9, wherein said means for storing sequences of said frames comprises means for recording said frames on magnetic tape, said recording means including means for generating digitally synthesized sinusoidal signals for application to said magnetic tape.

21. The instrument as defined by claim 17, wherein said sinusoidal signals are applied to said magnetic tape with the frequency shifts at the sinusoidal peaks.

22. The instrument as defined by claim 18, wherein said sinusoidal signals are applied to said magnetic tape with the frequency shifts at the sinusoidal peaks.

23. The instrument as defined by claim 19, wherein said sinusoidal signals are applied to said magnetic tape with the frequency shifts at the sinusoidal peaks.

24. The instrument as defined by claim 20, wherein said sinusoidal signals are applied to said magnetic tape with the frequency shifts at the sinusoidal peaks.

25. The instrument as defined by claim 1, wherein said frames include digital information representative of music-related information other than keyboard key activations.

26. The instrument as defined by claim 2, wherein said frames include digital information representative of music-related information other than keyboard key activations.

27. The instrument as defined by claim 4, wherein said frames include digital information representative of music-related information other than keyboard key activations.

28. The instrument as defined by claim 7, wherein said frames include digital information representative of music-related information other than keyboard key activations.

29. A musical keyboard instrument having an automatic playing capability, comprising:

a keyboard which includes a plurality of keys;
musical tone generators associated with said keys;
means for sensing, at a sensing time, which of the keys are activated;
means for generating a sequence of frames, each frame including digital information representative of the keys which are activated at a given sensing time;
means for encoding said frames in frequency shift keyed form;
means for storing encoded sequences of said frames on magnetic tape;
means for reading from said tape stored sequences of frames;
means for decoding the information in the read out frames; and
means for activating the tone generators in accordance with the decoded information.

30. The instrument as defined by claim 29, wherein the code of said frequency shift keying is formulated with a first frequency representative of a frame marker, a second higher frequency representative of one binary state, and a third even higher frequency representative of another binary state.

31. The instrument as defined by claim 29, wherein said storing means includes means for generating digitally synthesized sinusoidal signals for application to said magnetic tape.

32. The instrument as defined by claim 30, wherein said storing means includes means for generating digitally synthesized sinusoidal signals for application to said magnetic tape.

33. The instrument as defined by claim 31, wherein said sinusoidal signals are applied to said magnetic tape with the frequency shifts at the sinusoidal peaks.

34. The instrument as defined by claim 32, wherein said sinusoidal signals are applied to said magnetic tape with the frequency shifts at the sinusoidal peaks.

35. A musical keyboard instrument for recording and storing a musical performance, comprising:

a keyboard which includes a plurality of keys;
musical tone generators associated with said keys;
means for sensing, at a sensing time, which of the keys are activated;
means for generating a sequence of frames, each frame including digital information representative of the keys which are activated at a given sensing time, the duration of each frame being a function of the relative locations of the keys activated at the given sensing time;
each said sensing time being determined by the previously completed frame; and
means for storing sequences of said frames.

36. The instrument as defined by claim 35, wherein said means for storing sequences of said frames comprises means for recording said frames on magnetic tape.

37. The instrument as defined by claim 35, wherein said keys are divided into groups and the digital information for each frame includes identification of the groups that have one or more activated keys and identification of the individual keys that are activated within each group.

38. The instrument as defined by claim 36, wherein said keys are divided into groups and the digital information for each frame includes identification of the groups that have one or more activated keys and identification of the individual keys that are activated within each group.

39. The instrument as defined by claim 35, wherein said digital information is encoded in frequency shift keyed form.

40. The instrument as defined by claim 37, wherein said digital information is encoded in frequency shift keyed form.

41. The instrument as defined by claim 38, wherein said digital information is encoded in frequency shift keyed form.

42. The instrument as defined by claim 39, wherein the code of said frequency shift keying is formulated with a first frequency representative of a frame marker, a second higher frequency representative of one binary state, and a third even higher frequency representative of another binary state.

43. The instrument as defined by claim 40, wherein the code of said frequency shift keying is formulated with a first frequency representative of a frame marker, a second higher frequency representative of one binary state, and a third even higher frequency representative of another binary state.

44. The instrument as defined by claim 41, wherein the code of said frequency shift keying is formulated with a first frequency representative of a frame marker, a second higher frequency representative of one binary state, and a third even higher frequency representative of another binary state.

45. The instrument as defined by claim 38, wherein the identification of each group having activated keys is in the form of a binary number representing the reference number of said group, and wherein the individual keys within each said group are represented by individual binary bits.

46. The instrument as defined by claim 41, wherein the identification of each group having activated keys is in the form of a binary number representing the reference number of said group, and wherein the individual keys within each said group are represented by individual binary bits.

47. The instrument as defined by claim 44, wherein the identification of each group having activated keys is in the form of a binary number representing the reference number of said group, and wherein the individual keys within each said group are represented by individual binary bits.

48. The instrument as defined by claim 38, wherein most of said groups have about eight keys therein.

49. The instrument as defined by claim 44, wherein most of said groups have about eight keys therein.

50. The instrument as defined by claim 47, wherein most of said groups have about eight keys therein.

51. The instrument as defined by claim 39, wherein said means for storing sequences of said frames comprises means for recording said frames on magnetic tape, said recording means including means for generating digitally synthesized sinusoidal signals for application to said magnetic tape.

52. The instrument as defined by claim 40, wherein said means for storing sequences of said frames comprises means for recording said frames on magnetic tape, said recording means including means for generating digitally synthesized sinusoidal signals for application to said magnetic tape.

53. The instrument as defined by claim 42, wherein said means for storing sequences of said frames comprises means for recording said frames on magnetic tape, said recording means including means for generating digitally synthesized sinusoidal signals for application to said magnetic tape.

54. The instrument as defined by claim 43, wherein said means for storing sequences of said frames comprises means for recording said frames on magnetic tape, said recording means including means for generating digitally synthesized sinusoidal signals for application to said magnetic tape.

55. The instrument as defined by claim 51, wherein said sinusoidal signals are applied to said magnetic tape with the frequency shifts at the sinusoidal peaks.

56. The instrument as defined by claim 52, wherein said sinusoidal signals are applied to said magnetic tape with the frequency shifts at the sinusoidal peaks.

57. The instrument as defined by claim 53, wherein said sinusoidal signals are applied to said magnetic tape with the frequency shifts at the sinusoidal peaks.

58. The instrument as defined by claim 54, wherein said sinusoidal signals are applied to said magnetic tape with the frequency shifts at the sinusoidal peaks.

59. The instrument as defined by claim 35, wherein said frames include digital information representative of music-related information other than keyboard key activations.

60. The instrument as defined by claim 36, wherein said frames include digital information representative of music-related information other than keyboard key activations.

61. The instrument as defined by claim 38, wherein said frames include digital information representative of music-related information other than keyboard key activations.

62. The instrument as defined by claim 41, wherein said frames include digital information representative of music-related information other than keyboard key activations.

63. A musical keyboard instrument for recording and storing a musical performance, comprising:

a keyboard which includes a plurality of keys;

musical tone generators associated with said keys;

means for sensing, at a sensing time, which of the keys are activated;

means for generating a sequence of frames, each frame including digital information representative of the keys which are activated at a given sensing time;

means for encoding said frames in frequency shift keyed form; and means for storing encoded sequences of said frames on magnetic tape.

64. The instrument as defined by claim 63 wherein the code of said frequency shift keying is formulated with a first frequency representative of a frame marker, a second higher frequency representative of one binary state, and a third even higher frequency representative of another binary state.

65. The instrument as defined by claim 63, wherein said storing means includes means for generating digitally synthesized sinusoidal signals for application to said magnetic tape.

66. The instrument as defined by claim 64, wherein said storing means includes means for generating digitally synthesized sinusoidal signals for application to said magnetic tape.

67. The instrument as defined by claim 65, wherein said sinusoidal signals are applied to said magnetic tape with the frequency shifts at the sinusoidal peaks.

68. The instrument as defined by claim 66, wherein said sinusoidal signals are applied to said magnetic tape with the frequency shifts at the sinusoidal peaks.

* * * * *